US007328462B1

(12) United States Patent
Straus

(10) Patent No.: US 7,328,462 B1
(45) Date of Patent: Feb. 12, 2008

(54) PROTECTIVE HELMET

(76) Inventor: Albert E Straus, 2133 Pine Valley Dr., Timonium, MD (US) 21093

( * ) Notice: Subject to any disclaimer, the term of this patent is extended or adjusted under 35 U.S.C. 154(b) by 289 days.

(21) Appl. No.: 11/062,139

(22) Filed: Feb. 17, 2005

Related U.S. Application Data

(60) Provisional application No. 60/545,676, filed on Feb. 17, 2004.

(51) Int. Cl.
*A42B 3/06* (2006.01)

(52) U.S. Cl. ..... 2/411

(58) Field of Classification Search ..... 2/425, 2/9, 411, 412, 413, 414, 424, 909
See application file for complete search history.

(56) References Cited

U.S. PATENT DOCUMENTS

| | | | | | |
|---|---|---|---|---|---|
| 2,143,483 | A * | 1/1939 | Iglauer | 2/411 |
| 2,296,335 | A * | 9/1942 | Brady | 2/412 |
| 2,780,815 | A * | 2/1957 | Newland | 2/9 |
| 3,174,155 | A * | 3/1965 | Pitman | 2/411 |
| 3,186,004 | A * | 6/1965 | Carlini | 2/413 |
| 3,242,500 | A * | 3/1966 | Derr | 2/412 |
| 3,787,893 | A * | 1/1974 | Larcher | 2/413 |
| 3,815,152 | A * | 6/1974 | Bednarczuk et al. | 2/9 |
| 4,044,399 | A * | 8/1977 | Morton | 2/414 |
| 4,223,409 | A * | 9/1980 | Lee | 2/411 |
| 4,599,752 | A * | 7/1986 | Mitchell | 2/425 |
| 4,744,107 | A * | 5/1988 | Fohl | 2/422 |
| 4,937,888 | A * | 7/1990 | Straus | 2/411 |
| 5,343,569 | A * | 9/1994 | Asare et al. | 2/412 |
| 5,477,565 | A * | 12/1995 | Hunt, Jr. | 2/423 |
| 5,633,286 | A * | 5/1997 | Chen | 524/474 |
| 5,724,681 | A * | 3/1998 | Sykes | 2/425 |
| 5,956,777 | A * | 9/1999 | Popovich | 2/424 |
| 6,065,158 | A * | 5/2000 | Rush, III | 2/412 |
| 6,154,889 | A * | 12/2000 | Moore et al. | 2/418 |
| 6,226,801 | B1 * | 5/2001 | Alexander et al. | 2/413 |
| 6,292,954 | B1 * | 9/2001 | O'Bradaigh et al. | 2/424 |
| 6,336,220 | B1 * | 1/2002 | Sacks et al. | 2/22 |
| 7,096,512 | B2 * | 8/2006 | Blair | 2/410 |
| 2002/0152541 | A1 * | 10/2002 | Halstead et al. | 2/413 |

FOREIGN PATENT DOCUMENTS

FR 2566632 A1 * 1/1986

* cited by examiner

*Primary Examiner*—Shaun R. Hurley
(74) *Attorney, Agent, or Firm*—Richard K. Thomson

(57) ABSTRACT

A protective helmet of the type used in football has an external soft elastomer layer to absorb/dissipate some of the energy of an impact. Other features include a quick disconnect face guard, carbon fiber face guard with Kevlar wrap at junction points, a soft foam inner shell inside the intermediate hardened shell, and a head fitting structure including a plurality of pads, visco-elastic cells and at least one inflatable bladder. In addition, the hardened shell may be formed as a lattice frame of strips having a plurality of fibers impregnated with resin. The resin may have a dye added that will indicate if and where an impact exceeding a predetermined value is incurred by the helmet to assist a physician in diagnosing a possible head trauma injury.

15 Claims, 16 Drawing Sheets

PROTECTIVE HELMET

BACKGROUND

The present invention is directed to the field of sporting goods. More particularly, the present invention is directed to a helmet, such as a football helmet, with enhanced protection performance characteristics. The present application claims priority of provisional patent application Ser. No. 60/545,676 filed Feb. 17, 2004.

Over the course of many years, protective helmets have evolved for use in sporting activities and other pursuits for which there is a risk of head injury, including football, hockey, baseball, softball, lacrosse, roller skating, skate boarding, cycling, motorcycling, automobile racing, snowmobiling, skiing, horseback riding, climbing, construction work, police activities, firefighting, and military activities. Using football as an example, early helmets were made of sewn leather. Helmets evolved to molded plastic outer shells with suspension webbing on their interior. Later, the suspension webbing was replaced with other head fitting structures such as foam fit pads of various types, air filled bladders, and padding molded to fit a particular user's head. Variations of these concepts are used for protective helmets to the present day. The functions of these helmets is to absorb as much of the energy transmitted to the helmet by impact with another object, whether the object is equipment worn or used by another person, a body part of another person, the ground, or a structural object, as well as to deflect, to the extent possible, impacts which occur at an oblique angle to the helmet. The purpose of these helmets is to diminish the risk of head and brain injury resulting from the activities with respect to which the helmets are used. The most common head injuries that helmets are designed to reduce are brain concussions.

Over the past two decades, epidemiological data on concussions have been gathered. Using football as an example once again, in about 1999, an article in the *Journal of the American Medical Association* estimated that approximately 250,000 concussions are suffered annually by those participating in football. Many high profile professional football players in the National Football League ("NFL") had their careers shortened due to brain concussion injuries. Notable examples are Troy Aikman, Steve Young, and Merle Hodge. Concern has been raised about the prevalence of concussions incurred by those playing football, and this concern has been widely reported.

As a result, the NFL has launched a comprehensive study on the occurrence of concussions. Through the analysis of game films showing the impacts which occurred when concussions were suffered by NFL players, the mechanics of impacts resulting in concussions are being understood. The purpose is to continually apply the knowledge which is gained toward the further development of a helmet which reduces the occurrence of concussions. The hard exterior plastic shells of the helmets most commonly used by NFL players and the interior foam fit padding and air filled bladders most commonly used as head fitting structures for these helmets have the ability to absorb a certain amount of the impact energy when a helmet impacts an object. The impact energy that is not absorbed by the helmet is transferred to the skull of the user of the helmet, which can result in injury that can range from a mild concussion to severe brain injury. The most popular helmet currently being used in the NFL is the VSR4 manufactured by Riddell, Inc. Riddell, Inc. has also recently introduced a newer helmet for use by NFL players, as well as those playing football in college and high school, called the Riddell Revolution. Each of these helmets is constructed with hardened plastic exterior shell and commonly includes a form of foam fitting pads and/or air filled bladders as a head fitting structure mounted within each shell.

In the course of the study of head and brain injuries resulting from impacts with the head, researchers have developed various indices that attempt to identify and select the part of a measured acceleration pulse resulting from a head impact that would most likely contribute to injury. A mathematical relationship which resulted from this research is known as the Head Injury Criterion ("HIC"). HIC was incorporated into the Federal Motor Vehicle Safety Standards by the National Highway Traffic Administration. Standardized tests measuring the HIC of helmets are widely accepted in evaluating the ability of helmets to diminish the risk of impact head injury. It has been reported that HIC values of 1,000 and above resulting from the test for HIC represent conditions of moderate to severe brain injury, HIC values between 850 and 1,000 are likely to correspond to conditions of mild brain injury, and HIC levels below about 700 are considered not to be severe enough to cause mild brain injury. Thus, the lower the HIC measured by the standardized test the more effective a helmet is likely to be in reducing brain injury due to impact. The development of HIC is discussed in Lawrence M. Ilson, Ph.D. and Carley C. Ward, Ph.D., "Mechanisms and Pathophysiology of Mild Head Injury," Seminars in Neurology, Volume 14, No. 1, March 1994, pp. 8-18.

The Biomechanical Engineering Laboratory of Wayne State University has been in the forefront of research regarding brain injury from impact, in the development of the HIC and the standardized test to measure it, and in testing helmets to determine their HIC levels. The NFL has recommended that helmets developed for potential use in the NFL be tested by the Biomechanical Engineering Laboratory of Wayne State University.

In an attempt to further improve existing helmets, the inventor of this invention developed a helmet cover which could be placed over and secured to an existing helmet without modifying the helmet. This helmet cover was an elastomeric cellular, foam material having an integral inner skin and an integral outer skin. The foam material had physical characteristics which caused it to absorb energy from impact with another object, and rapidly and fully recover to absorb energy from the next impact, thereby reducing the potential for injury to the wearer of the helmet on which the helmet cover was mounted. This helmet cover is the subject of U.S. Pat. No. 4,937,888 issued to Albert E. Straus on Jul. 3, 1990. Knowledge gained from the development and use of the helmet cover on existing helmets and gained from a study of the continuing research discussed above had led to the development of a fully integrated helmet system which outperforms alternatives when measured by the latest laboratory standards, as well as the development of helmet subsystems which can be useful in other helmets.

SUMMARY

In one embodiment, a helmet for protecting the head of a user of the helmet includes a hardened shell having an inside surface and an outside surface. The helmet also includes an outer layer comprising an elastomeric, cellular foam material that has an integral inner skin and an integral outer skin that is abrasion resistant and has a low coefficient of friction. The elastomeric, cellular foam material has physical characteristics that cause it to absorb some of the energy due to an impact with an object and rapidly and fully recover to absorb energy from the next impact. The outer layer is mounted on the hardened shell so that the outer layer's inner skin is adjacent the outside surface of the hardened shell. The hardened shell can be a solid structure or can be constructed from materials which allow it to be in the form of a frame.

A foam inner shell is normally located at a first position within the hardened shell. A plurality of visco-elastic cells is located between the inner shell and the inside surface of the hardened shell so as to form an air space between at least a portion of the inner shell and the inside surface of the hardened shell. A visco-elastic cell is a package of material that is normally in a fluid state, but rapidly solidifies as it deforms in response to the force of an impact. Thus, when the helmet receives an impact the visco-elastic cells deform to allow a limited movement of the inner shell from its first position within the air space, thereby absorbing components of the energy from the impact. A head fitting structure can be located within the inner shell. While the head fitting structure can be of any type desired, normally the head fitting structure is constructed to absorb a portion of the energy of impact.

Some helmets that use a hardened shell as an outer layer will benefit from incorporating a foam inner shell within the hardened shell and mounting a plurality of visco-elastic cells between the inside surface of the hardened shell and the foam inner shell to form an air space between the inner shell and the inside surface of the outer shell, as described above. The limited movement of the inner shell due to the deformation of the visco-elastic cells following an impact will dissipate components of the energy from the impact, as explained above, thereby benefiting the user of the helmet.

Another embodiment of the helmet includes an outer layer comprising the elastomeric, cellular foam material, described above, which has an integral inner skin and an integral outer skin that is abrasion resistant and has a low coefficient of friction. As previously stated, the elastomeric, cellular foam material has physical characteristics that cause it to absorb some of the energy due to an impact with an object and rapidly and fully recover to absorb energy from the next impact. As a result of using this elastomeric, cellular foam material with the described integral skin as the outer layer, the hardened shell can be constructed out of resin-impregnated fibers so as to reduce the weight of the hardened shell and substantially increase its strength-to-weight ratio. While a solid, hardened shell made of resin impregnated fibers can be advantageously constructed for such a helmet, due to the strength-to-weight ratio of resin impregnated fibers, the helmet can be constructed as a frame which includes elongated frame members, thereby further decreasing the weight of the helmet and thus decreasing the load on the head of someone using it.

Various other features, advantages, and characteristics of the present invention will become apparent to one of ordinary skill in the art while reading the following specification. This invention does not reside in any one of the features of the helmet disclosed below. Rather, this invention is distinguished in the prior art by its particular combination of features which are disclosed. Important features of this invention have been described below and shown in the drawings to illustrate the best mode contemplated to date for carrying out this invention.

Those skilled in the art will realize that this invention is capable of embodiments which are different from those shown and described below, and that the details of the structure of this helmet can be changed in various manners without departing from the scope of this invention. Accordingly, the drawings and description below are to be regarded as illustrative in nature and are not to restrict the scope of this invention. The claims are to be regarded as including such equivalent helmets as do not depart from the spirit and scope of this invention.

BRIEF DESCRIPTION OF THE DRAWINGS

For a more complete understanding and appreciation of this invention and its many advantages, reference will be made to the following, detailed description of this invention taken in conjunction with the accompanying drawings in which.

DETAILED DESCRIPTION OF THE PREFERRED EMBODIMENTS

Figure 1:
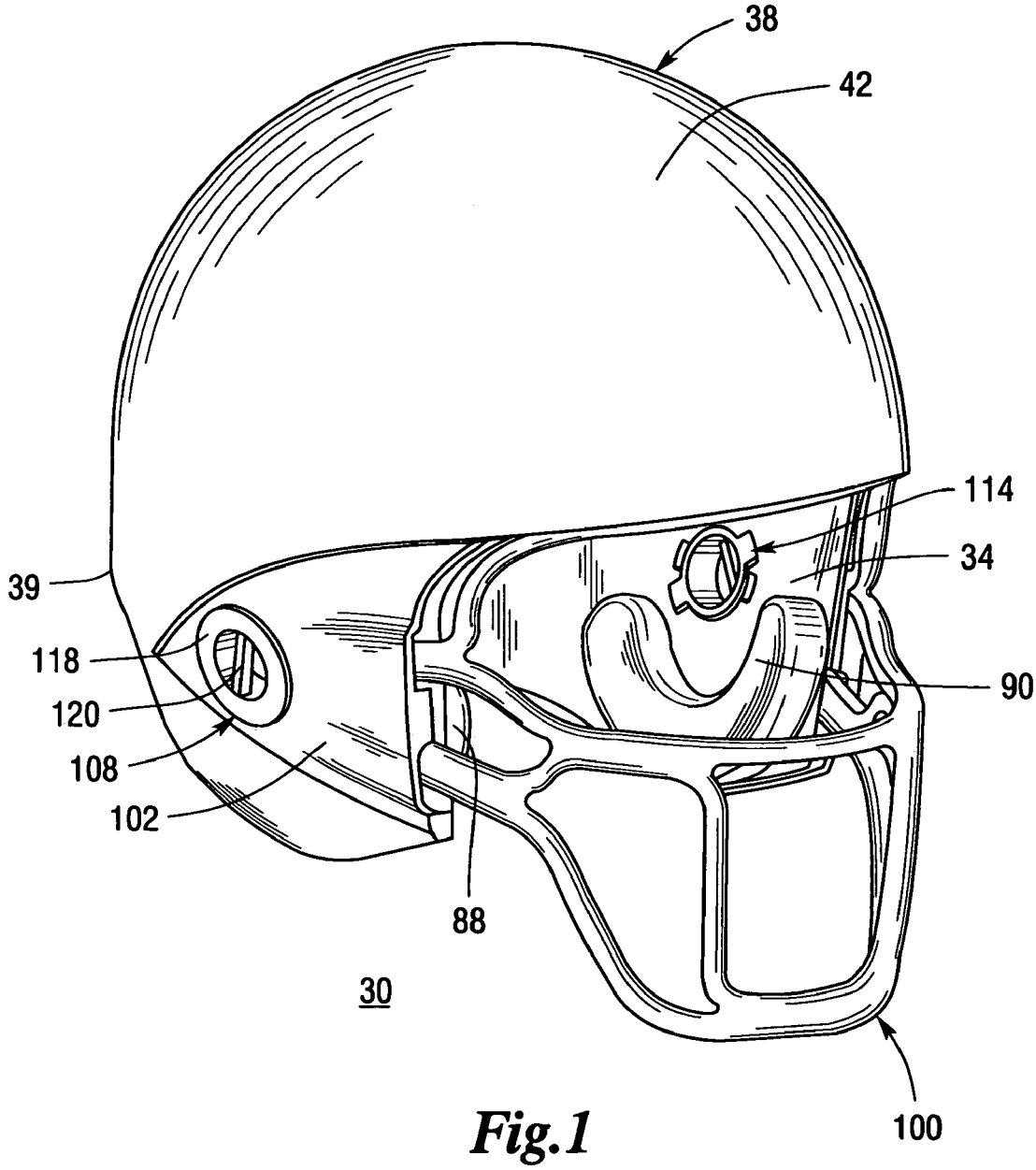
FIG. 1 is a perspective view of one embodiment of a particular helmet of this invention illustrated as a football helmet.
Figure 1B:
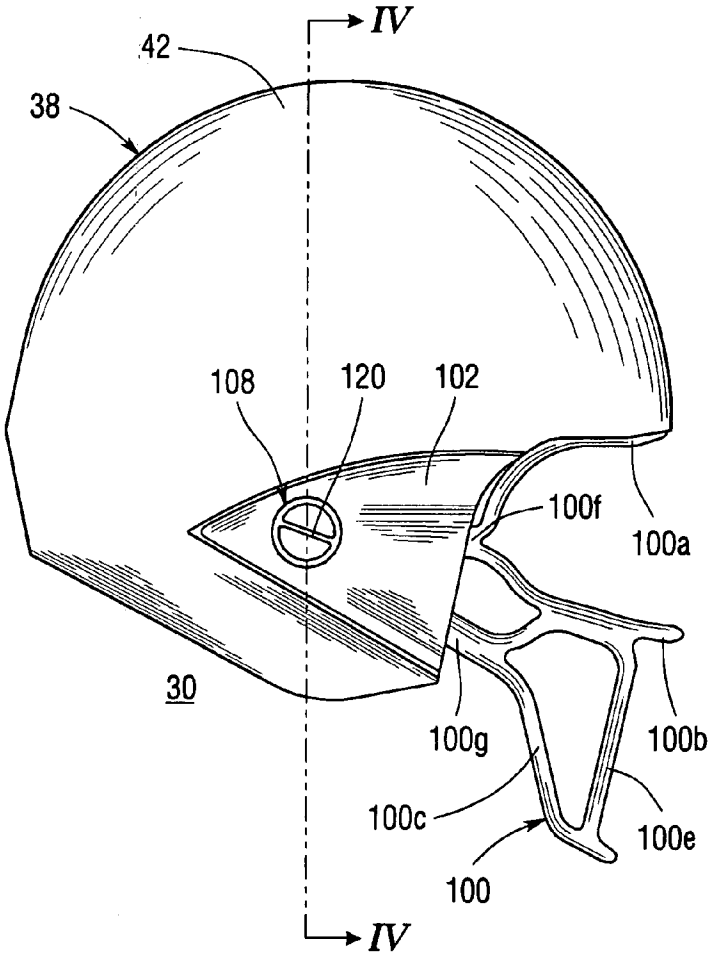
FIG. 1*b* is a side view of the helmet of FIG. 1.
Figure 1A:
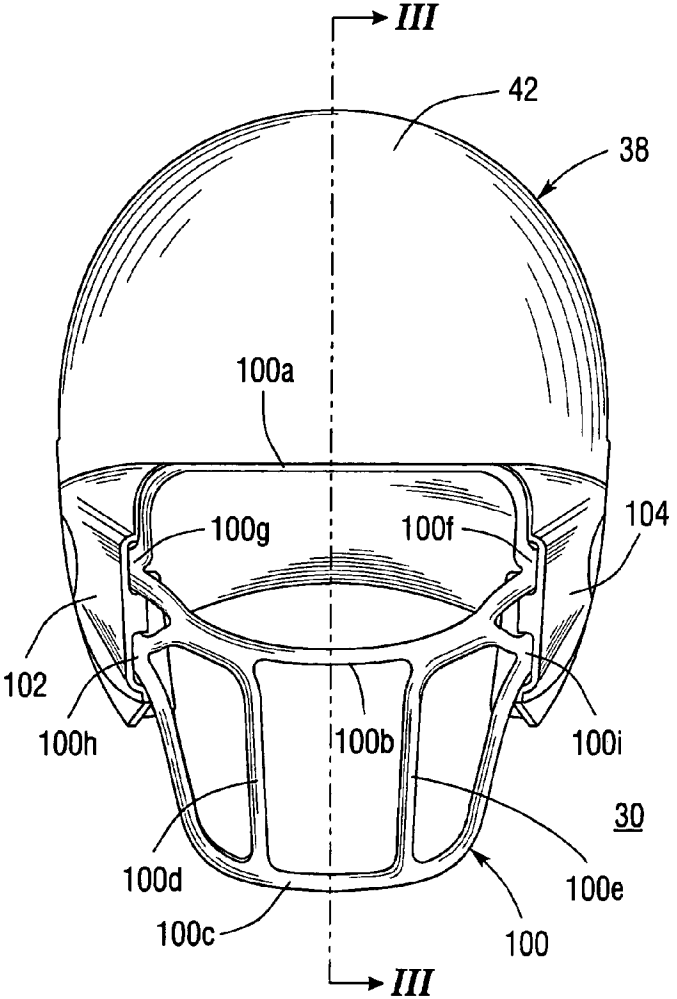
FIG. 1*a* is a front view of the helmet of FIG. 1.

Referring to the drawings, identical reference numerals and letters designate the same or corresponding parts throughout the several figures which are shown.

FIGS. 1-4 will be referenced initially to describe one embodiment of this invention. FIG. 1 shows a protective helmet 30 constructed according to this invention for use as a football helmet. Referring to the exploded view of the helmet shown in FIG. 2, the helmet 30 includes a hardened shell 32 which has an inside surface 34 and an outside surface 36. The helmet 30 also includes an outer layer 38 comprising an elastomeric, cellular foam material that has an integral inner skin 40 and an integral outer skin 42. The elastomeric, cellular foam material of the outer layer 38 has physical characteristics that cause it to absorb some of the energy exerted on the helmet 30 as a result of an impact on the helmet 30 with an object and to rapidly and fully recover to absorb energy from the next impact. The integral outer skin 42 must be strong and tough so as to resist tears and abrasion due to impacts with objects. It should also have a low coefficient of friction so that it can deflect impacts which occur at an oblique angle to the surface of the helmet 30. One material that meets these requirements is a urethane polyol produced by a reaction molded process to provide a flexible urethane foam that is self-skinning and meets the following specifications:

| Product | SES-5304 |
|---|---|
| Density | 0.12-0.15 g/cc |
| Tensile (D412) | 260-300 psi |
| Elongation | 70-100% |
| Tear Die C (ASTM D624) | 27-37 lbs/in. |
| Tear F.F. (ASTM D3574) | 3.0-3.6 lbs/in. |
| C.F.D. (ASTM D3574C) | 12-15 lbs. |
| Ball Rebound | 42-52% |
| Shore A | 50-60 |
| Coefficient of Friction | |
| Static (ASTM D1894) | 0.27-0.35 |
| Kinetic (ASTM D1894) | 0.20-0.28 |
| Taber Abrasion | |
| CS-17 | 0 mg/1000 cycles |
| H-18 | 320 mg/1000 cycles |

These physical properties are exemplary and are subject to changes relative to density of the polyurethane and molding conditions.

A product of this type is sold by HEHR International of Conyers, Ga. and is mixed as one part catalyst and four parts polyurethane. The mixture is placed into a secure mold with a humidity free environment to form the outer layer 38 and has a de-mold time of three minutes. To cause the outer skin 42 to grow thicker than the inner skin 40 so as to withstand impacts, the temperature of the core side of the mold is set at 130° F. The temperature of the cavity side of the mold is set at 95° F. since the inner skin 40 can be thinner.

Integral outer skin can also be formed on the outer layer 38 when the elastomeric, cellular foam material produced is not self-skinning. First, place an insert, such as a silicone material, into the core side of the tool to replicate the volume of the foam to the outer layer 38. This insert becomes a new core. Add a tough, high density material, such as urea, to the tool to form an outer skin. Once the skin is formed on the tool, the insert is removed from the mold and the skin is allowed to remain on the cavity side. The material used to form the outer layer 38 is then placed into the mold and is foamed to become integral with the previously formed skin so as to form an outer layer with an integral skin. Normally, any self-skinning of a foaming material is sufficient as the inner skin since the inner skin is not subject to abuse.

Figure 3:
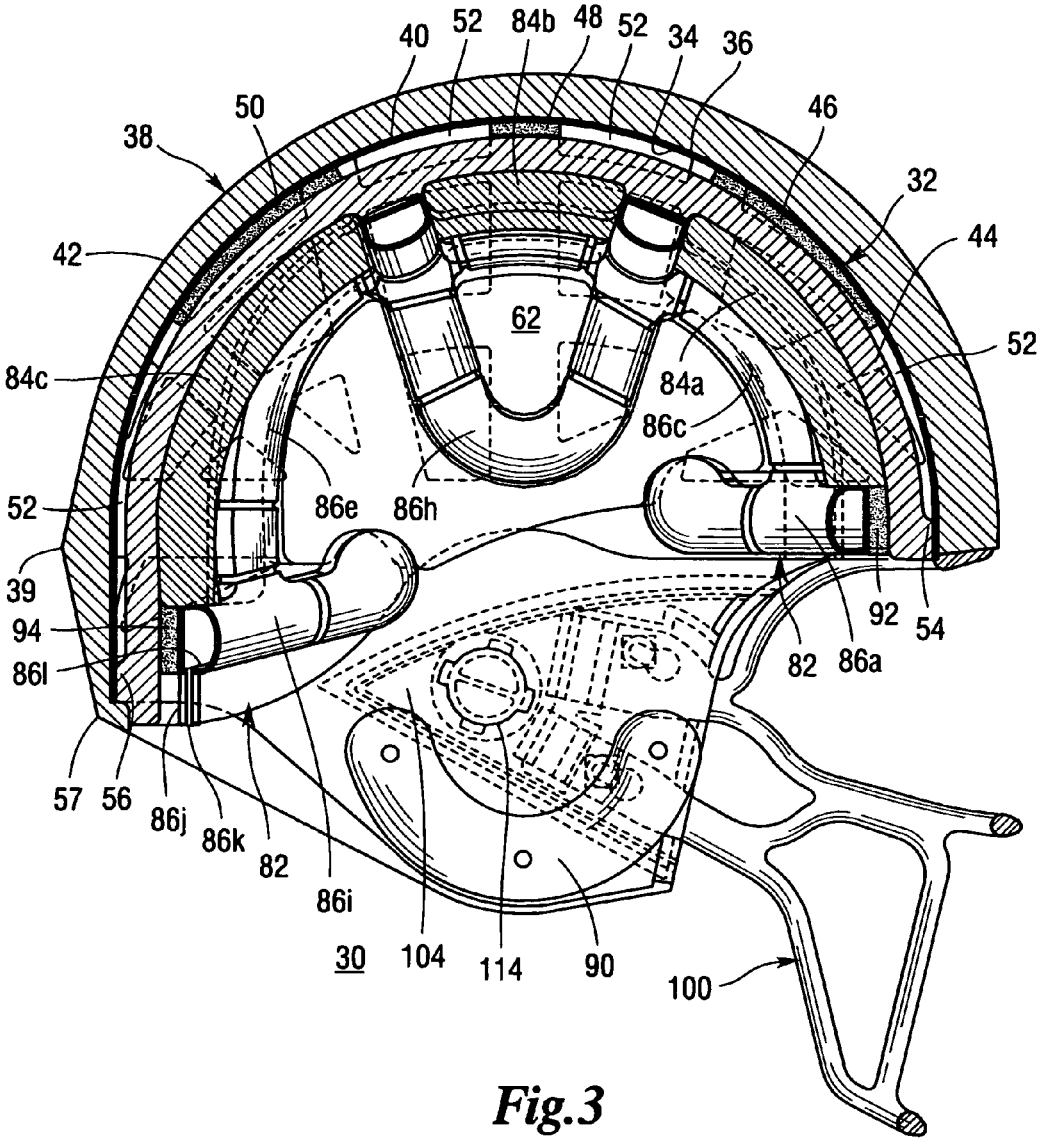
FIG. 3 is a side section view along the line 3-3 of the helmet shown in FIG. 1*a;*
Figure 3A:
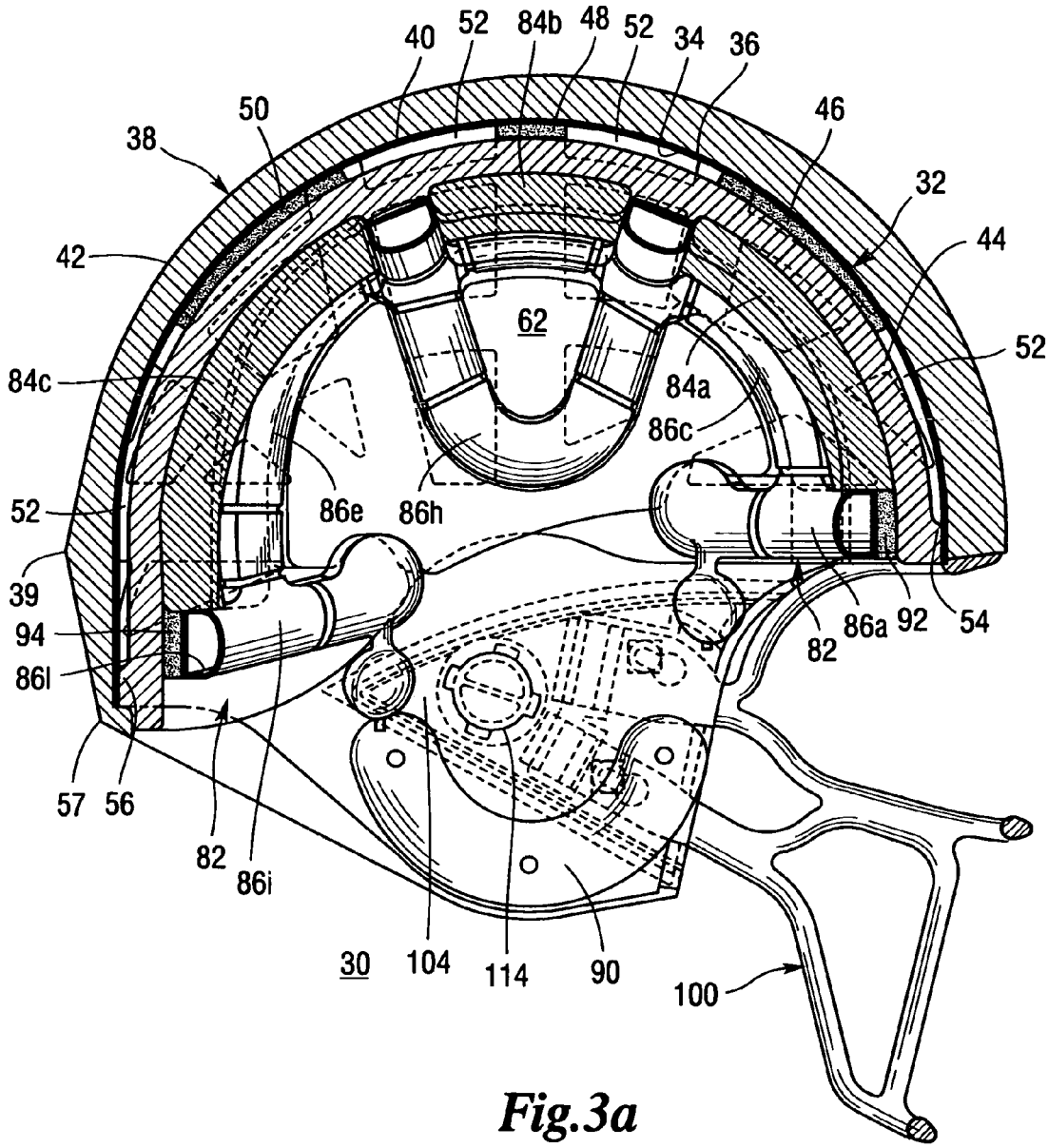
FIG. 3*a* is identical to FIG. 3, except that a self inflatable bladder is shown.

As seen in FIG. 3, the outer layer 38 is configured so that it is thicker in areas where impact is customarily greater, providing a greater absorption of impact energy at those areas. Thus, the outer layer is thickest at about the front of the helmet 30 and tapers in thickness toward the rear. In the embodiment shown in FIG. 3, the outer layer 38 increases in thickness to an area 39 near the bottom of the rear of the helmet 30 to absorb potential impacts of the back of a helmeted head with the ground or another object. As shown in the front section view of FIG. 4, the outer layer 38 is thickest at about a 120° arc centered at the top of the helmet and tapers in thickness toward each side. The outer layer 38 can be finished in the desired color or colors by adding coloring and ultraviolet ray protection to the mold cavity when the outer skin 42 is formed.

The outer layer 38 is mounted on the hardened shell 32 so that the inner skin 40 is adjacent the outside surface 36 of the hardened shell 32. The outer layer 38 is more resilient than the unforgiving hardened outer shell of most other football helmets, allowing the outer layer 38 to initially absorb energy of impact with an object before it disburses unabsorbed energy through the hardened shell 32. This is the first component of a selective layering of spring like materials that allows the helmet 30 to accommodate the varying frequencies of impact vibrations.

A foam inner shell 44 is constructed of a size and shape that enables it to be mounted within the hardened shell 32. The inner shell 44 should be chosen to be extremely lightweight and to have the ability to absorb high impact. It must be economically configured to facilitate the location of one or more components of a head fitting structure, such as fit pads, and to facilitate the placement of ventilation paths within it. One material that was found to be satisfactory for this purpose is an expanded polyethylene or polypropylene foam having a density of about 3-3.5 pounds per cubic foot which is manufactured and sold by Shell Chemical Company.

Figure 4:
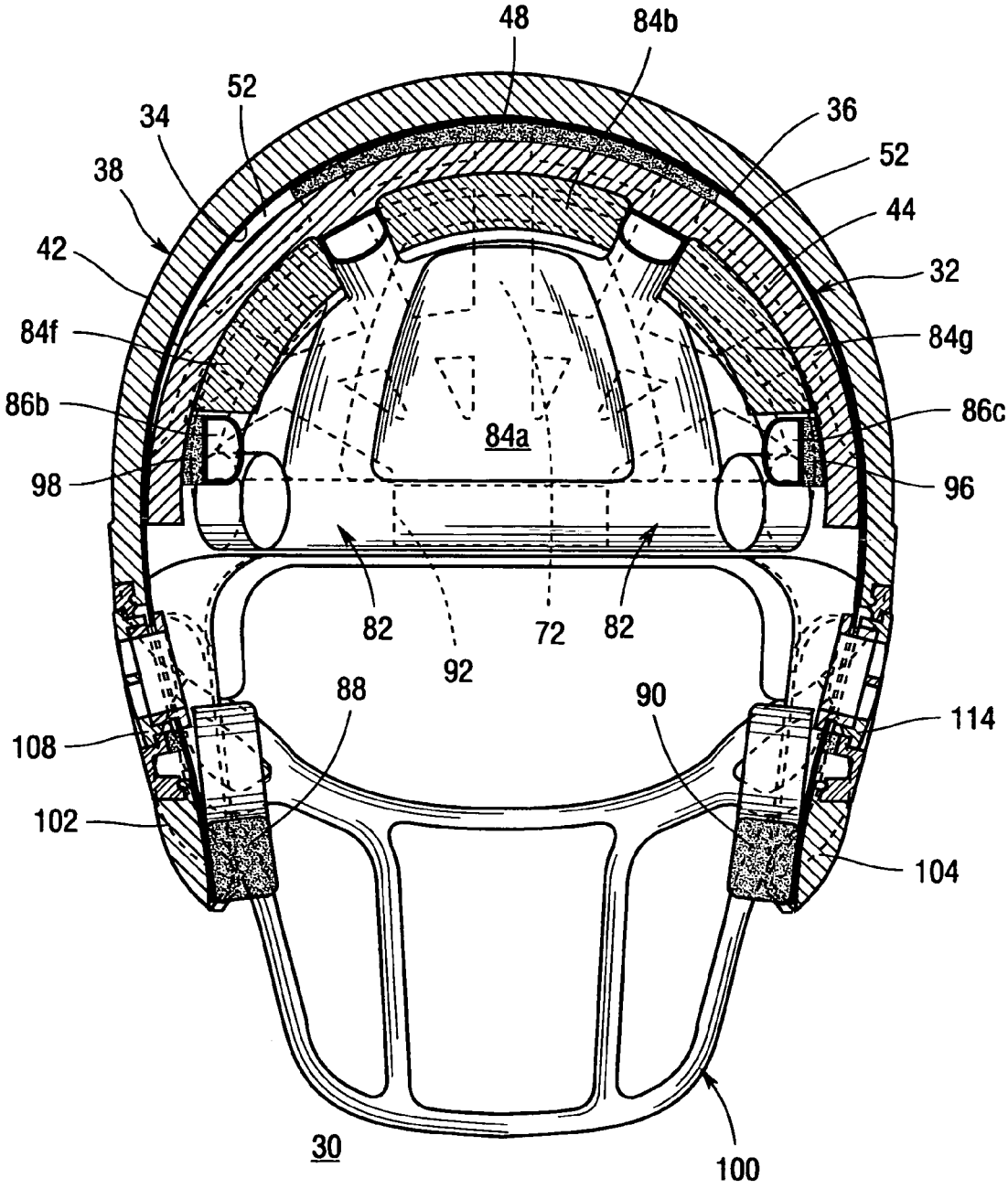
FIG. 4 is a front elevation section along the line 4-4 of the helmet shown in FIG. 1*b;*

As best seen in FIGS. 3 and 4, the inner shell 44 is located at a first, normal position within the helmet 30 by a plurality of visco-elastic cells 46, 48, and 50, which are mounted between the inner shell 44 and the inside surface 34 of the hardened shell 32. As indicated above, a visco-elastic cell is a flexible plastic package of material that is normally in a fluid state, but rapidly solidifies as it deforms in response to the force of an impact. Visco-elastic material is a polymer that solidifies from its normal fluid state in proportion to the energy applied upon impact and then returns to its original fluid state. It does not return to its normal fluid state as rapidly as the outer layer 38 recovers from an impact. These characteristics of the visco-elastic cells 46, 48 and 50 give them a lower vibration frequency response than that of the outer layer 38. Visco-elastic cells are manufactured and sold under the trademark REASORB by Impact Innovative Products, Inc. of Manor, Pa.

Figure 2:
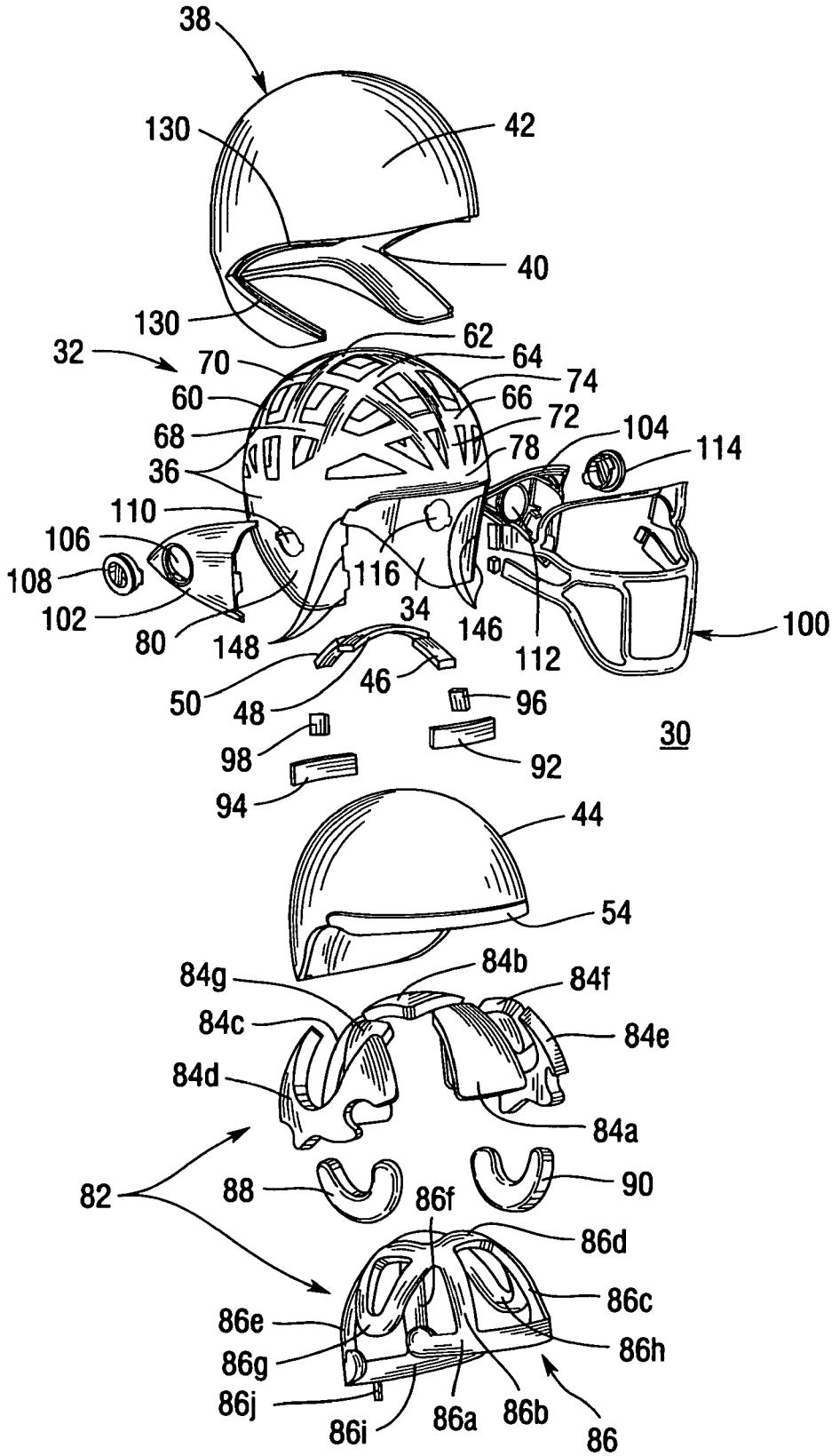
FIG. 2 is an exploded view of the football helmet of FIG. 1.

The installation of the visco-elastic cells 46, 48, and 50 between the hardened shell 32 and the foam inner shell 44 forms an air space 52 between at least a portion of the inner shell 44 and the inside surface 34 of the hardened shell 32. As seen in FIGS. 2 and 3, the inner shell 44 includes a raised ridge 54 which extends around the front end of the helmet. The ridge 54 holds the inner shell 44 away from the inside surface 34 of the hardened shell 32 at the front of the helmet, thereby helping to form the portion of the air space 52 near the front of the helmet. Similarly, a ridge 56 which runs along the back end of the foam inner shell 44 assists in forming that portion of the air space 52 which exists toward the rear of the helmet. A ledge 57 that extends inwardly at the rear end of the outer layer 38 contacts the bottom of the ridge 56 to help support the inner shell 44.

Figure 5:
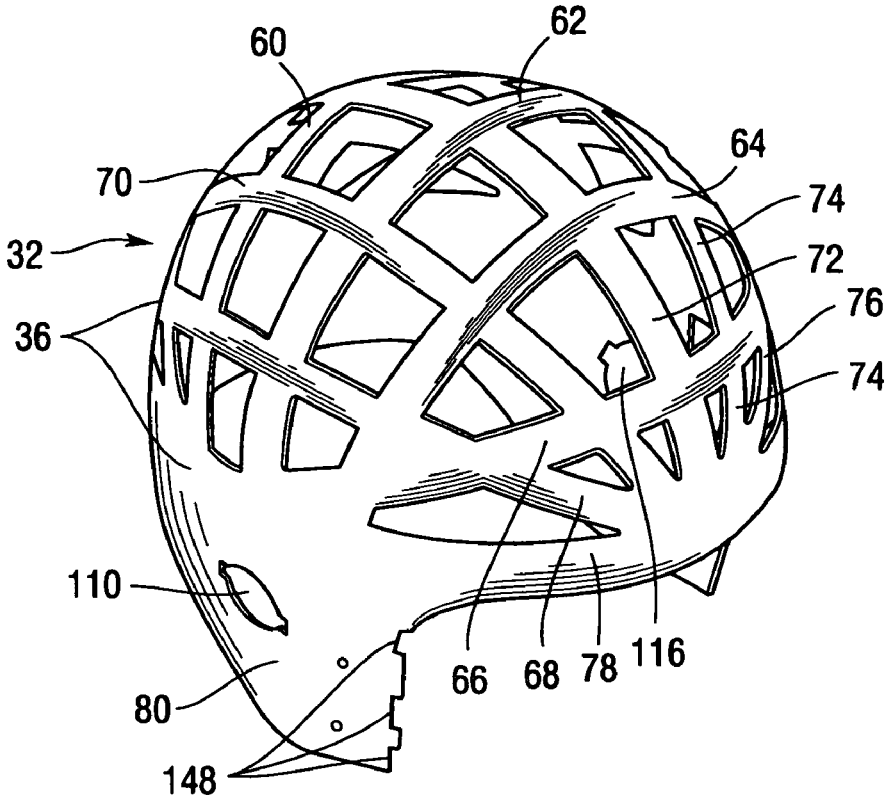
FIG. 5 is a perspective view of the hardened frame shell.
Figure 6:
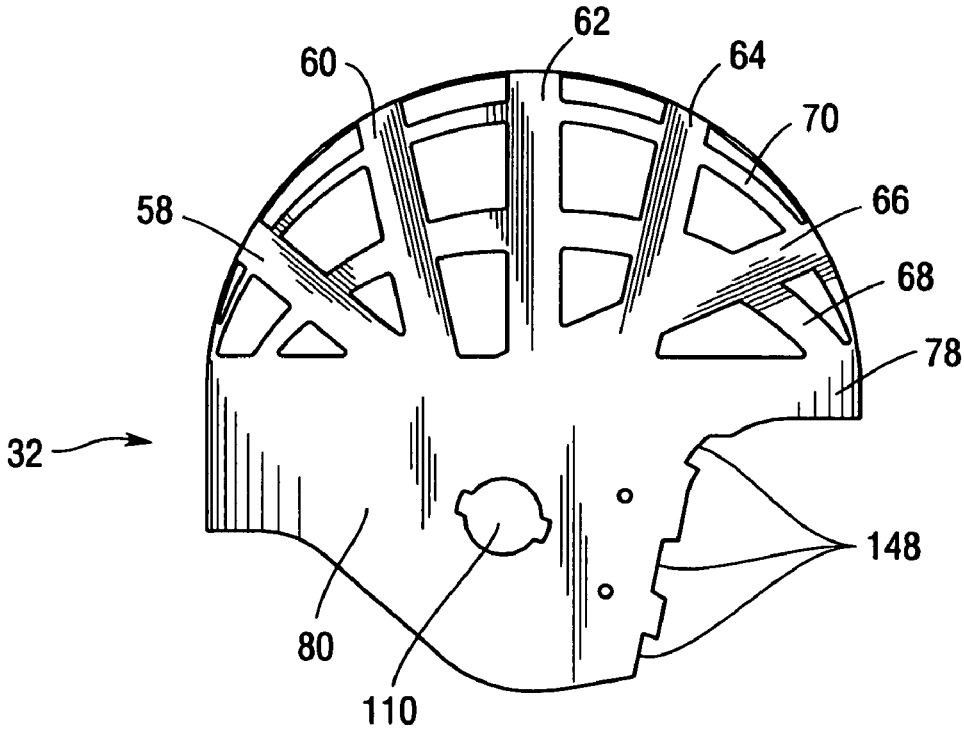
FIG. 6 is a side view of the hardened frame shell.
Figure 7:
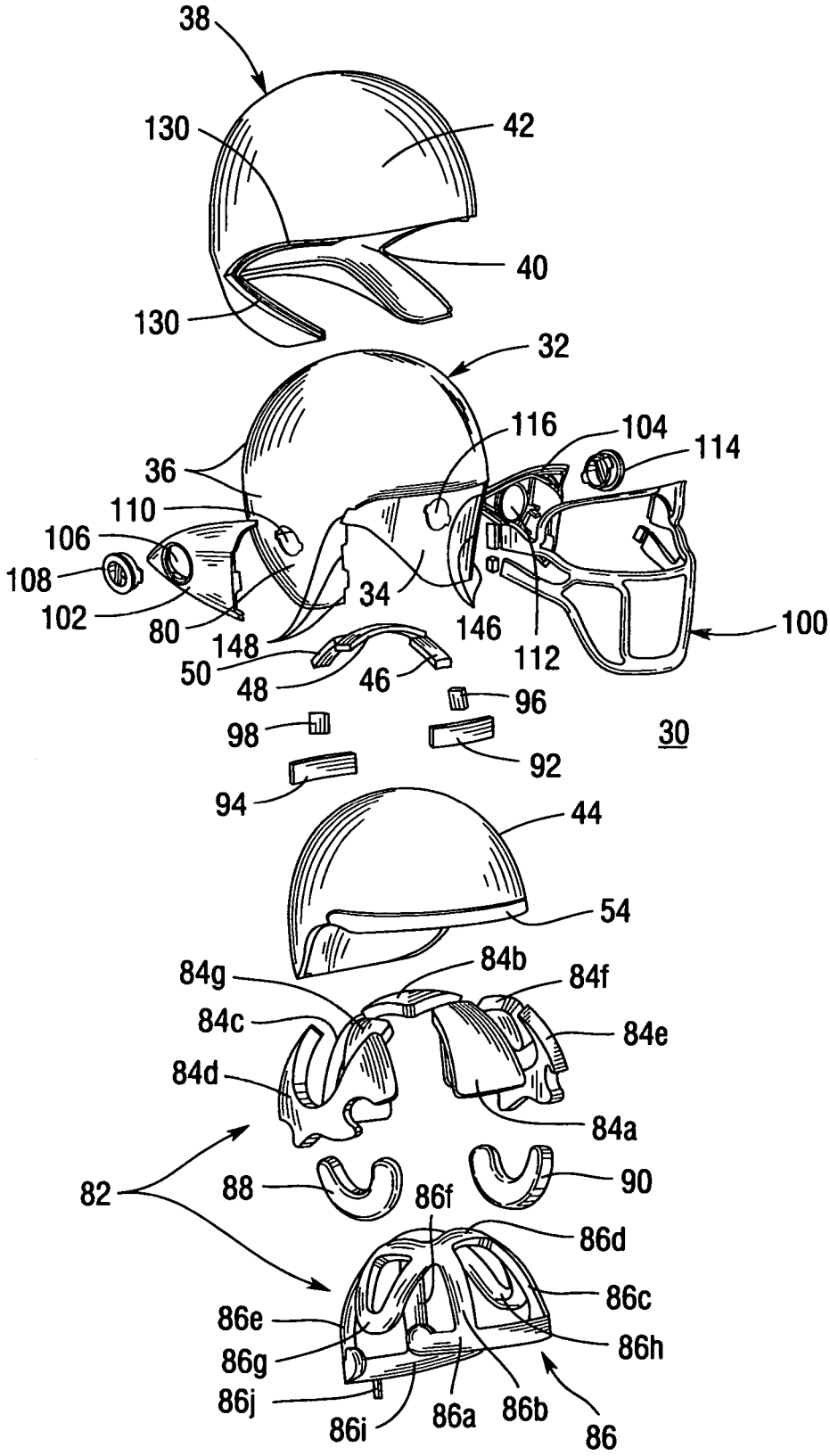
FIG. 7 is an exploded view of a helmet with a solid shell.

Referring now to FIGS. 5 and 6, the hardened shell 32 comprises a frame which includes a first plurality of lateral frame members 58, 60, 62, 64, and 66 which extend laterally across the helmet 30, and a second plurality of longitudinal frame members 68, 70, 72, 74 and 76 which extend in a longitudinal direction with respect to the helmet and cross the lateral frame members 58, 60, 62, 64, and 66.

The visco-elastic cell 48 is installed beneath the top of the helmet adjacent the inside surface of the lateral frame member 62 and is centered with respect to the longitudinal frame member 72 as shown in FIGS. 3 and 4. The visco-elastic cell 46 is installed on the longitudinal frame member 72, toward the front of the helmet 30 as shown in FIG. 3, while the visco-elastic cell 50 is installed on the longitudinal frame member 72, toward the rear of the helmet 30. The purpose of this configuration is to install one of the visco-elastic cells 48 at the center of the top of the helmet and the other two visco-elastic cells 46 and 50 centered toward the front and rear of the helmet, respectively, so that helmet structure spreads the reaction of the visco-elastic cells to an impact force and their absorption of impact energy between the front and back of the helmet. The visco-elastic cells 46, 48 and 50 could be oriented onto other lateral and longitudinal frame members and/or additional visco-elastic cells could be added between the hardened shell 32 and the inner shell 44 as needed to further absorb energy of impact that has been transferred from the outer layer 38 to the hardened shell 32. The exact physical characteristics, number, size and orientation of the visco-elastic cells needed to optimize the performance of a particular helmet are determined empirically.

Following impact of the helmet 30 with an object, the outer layer 38 absorbs some of the energy of impact, as described above. Unabsorbed impact energy is then dispersed through the hardened shell 32 to the visco-elastic cells 46, 48 and 50 which deflect to a limited extent until they solidify in proportion to the level of impact energy. The inner shell 44 moves to a limited extent, or floats, within the air space 52 as the visco-elastic cells deform while the visco-elastic material solidifies.

One preferred embodiment of the hardened shell 32 is made from fibers impregnated with a thermal setting resin that can be heated under a vacuum in an autoclave to hold the fibers together. Each of the lateral frame members 58, 60, 62, 64 and 66 and each of the longitudinal frame members 68, 70, 72, 74 and 76 has a pair of ends which terminates at a lateral band 78 that is a strip of material that encircles the equator of the helmet. The lower half 80 of the hardened shell 32 is also made from resin impregnated fibers.

The method of construction of an item such as the hardened shell from fibers wetted with thermal setting resin is well known to those skilled in the art. Generally speaking, a tool is constructed that can receive and retain strips of resin impregnated fibers in the shape of the hardened shell itself. One or more layers of the resin impregnated fibers are used to form the lateral frame members, the longitudinal frame members, the lateral band 78 and the lower half 80 of the hardened shell 32. The hardened shell 32 itself should be constructed with a strength that allows it to receive impact force through the outer layer 38 and disperse that force without losing its shape. One such hardened shell was constructed by Composiflex, Inc. of Erie, Pa. out of carbon fibers wetted with an epoxy resin. Up to eight layers of resin impregnated fibers were used to form each component of the hardened shell. While the fibers of each layer of the lateral frame members 58, 60, 62, 64 and 66, the longitudinal frame members 68, 70, 72, 74 and 76 and the lateral band 78 extended in the same direction, the lower half 80 of the hardened shell 32 was formed of alternating sheets of epoxy resin impregnated carbon fibers that had the carbon fibers at right angles in each adjacent sheet.

The hardened shell 32 can be made from materials other than epoxy resin impregnated carbon fibers. It can also be made from such materials as glass fibers, boron fibers and Kevlar fibers, as well as carbon fibers, any of which can be impregnated with epoxy resin, vinyl ester resin or polyester resin. Once a hardened shell is formed over a tool in which the shape of the desired frame, it can be heated in a vacuum within an autoclave to cure the resin under pressure.

Another feature of the present invention has been evaluated through empirical tests. By inserting a dye into the resin used in laying up the frame of the hardened shell, a visual indication that a blow to the helmet of a predetermined amount has been experienced by the hardened shell and, therefore, that a blow of a known lesser force has been experienced by the wearer's head. The predetermined magnitude of the blow can be adjusted by the amount of dye added to the resin and may range, for example, between 80 and 120 G's with the desired optimum being 100 G's. The helmet will register not only the fact that the impact has occurred but the exact location. This can be important in diagnosing the degree and location of head trauma suffered by a player that leaves the field of play in a dazed condition. The assessment may be made by either removing the inner shell 44 or the outer layer 38 to determine whether an impact-indicating discoloration has occurred.

Referring now to FIGS. 2-4, the helmet 30 further includes a head fitting structure 82 installed within the foam inner shell 44. While the head fitting structure 82 could take any form that a user desires, it is preferable that it include padding which is capable of absorbing impact energy transmitted through the inner shell 44. By way of illustration, the embodiment of this invention shown in FIGS. 2 and 3 includes a series of fit pads 84*a*, 84*b*, 84*c*, 84*d*, 84*e*, 84*f* and 84*g* that are mounted within the foam inner shell 44. Fit pad 84*a* is installed toward the front of the helmet, fit pad 84*b* is installed at the middle of the helmet, fit pad 84*c* is installed at the rear of the helmet, fit pads 84*d* and 84*f* are installed at the helmet user's right side and fit pads 84*e* and 84*g* are installed on the user's left side. All of the fit pads were made from a foam material that was chosen empirically to optimize the performance of the helmet 30 in absorbing the energy of its impact with an object. Preferably, the material of the fit pads 84*a*-84*g* are selected to respond to a different frequency of vibration caused by impact than the other components of the helmet 30. One foam material which was satisfactorily tested to make fit pads for the helmet 30 is sold under the trademark ENSOLITE® AHC by RBX Industries, Inc. of Roanoke, Va. and has the following physical properties:

Foam Fit Pads

| Type | AHC |
|---|---|
| Polymer | Polyvinyl Chloride/Acrylonitrile Butadiene Rubber |
| ASTM D1056-00 Classification | 2B2 |
| Suffix Requirements | B3, C1, M |
| 1. 25% Compression Resistance (psi) (ASTM D-1056) | 7.0-9.0 |
| 2. 50% Compression Set (%) (ASTM D-1056) | 30 |
| 3. Density (lb/ft$^3$) (ASTM D-1056) | 6.5-8.5 |
| 4. Water Absorption (lb/ft$^3$) (ASTM D-1667) | 0.1 max. |
| 5. Tensile (psi) (ASTM D-412) | 90 min. |
| 6. Elongation (ASTM D-412) | 100 min. |
| 7. Flammability-MV38302 | Pass |
| UL94 | HF-1 - ⅛" min.<br>VO - ½ |

The foam fit pads 84*a*-84*g* can be sized and shaped to produce a comfortable fit on the head of a user of the helmet 30. These pads may be encapsulated in a fabric which wicks moisture generated by the user. In accordance with the normal construction of head fitting structures used in regulation football helmets, the foam fit pads 84*a*-84*g* are separated from one another when they are installed so as to allow space for the installation of an air inflatable bladder 86 made up of a series of relatively narrow inflatable bladder elements 86*a*-86*i* which are nestled between adjacent fit pads. A valve stem 86*j*, shown in FIG. 3, has a hole 86*k* within it which leads to a rubber flap check valve 86*i* within bladder element 86*i*. An air pump can be attached to the stem 86*j* to inflate the bladder 86 through the rubber flap check valve 86*l* to tighten the fit of the helmet on the head of the user.

Visco-elastic cells can also be mounted between the foam inner shell 44 and components of the head fitting structure 82 to further absorb impact energy transmitted through a foam inner shell 44. The use of visco-elastic cells is particularly useful near the lower ends of the inner shell 44 which are remote from the more central areas of the shell that benefit from the impact energy absorption characteristics of the combination of the visco-elastic cells 46, 48 and 50 and the air space 52. Thus, as seen in FIGS. 2-4, visco-elastic cells 92 and 94 are placed between the front and rear inside surfaces of the inner shell 44 and the bladder elements 86*a* and 86*i*, respectively. In a similar manner, as seen in FIG. 4, visco-elastic cells 96 and 98 are placed between the user's lower left hand and lower right hand portions of the inner shell 44 and the bladder elements 86*c* and 86*b*, respectively.

Referring once again to FIGS. 2-4, the helmet 30 further includes a pair of jaw pads 88 and 90 installed adjacent the user's lower right and left side extensions, respectively, of the inside surface 34 of the hardened shell 32. The selection of appropriate jaw pads is well within the skill of those persons who design and fit football helmets.

Figure 10:
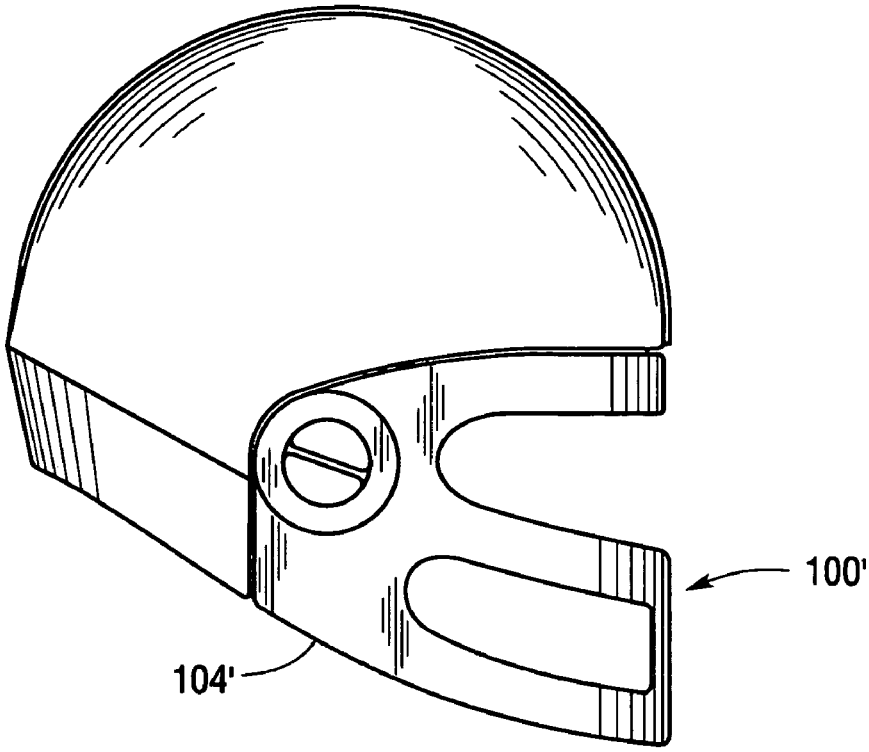
FIG. 10 is a side view of a helmet with a face guard integrated with the side plate.
Figure 11:
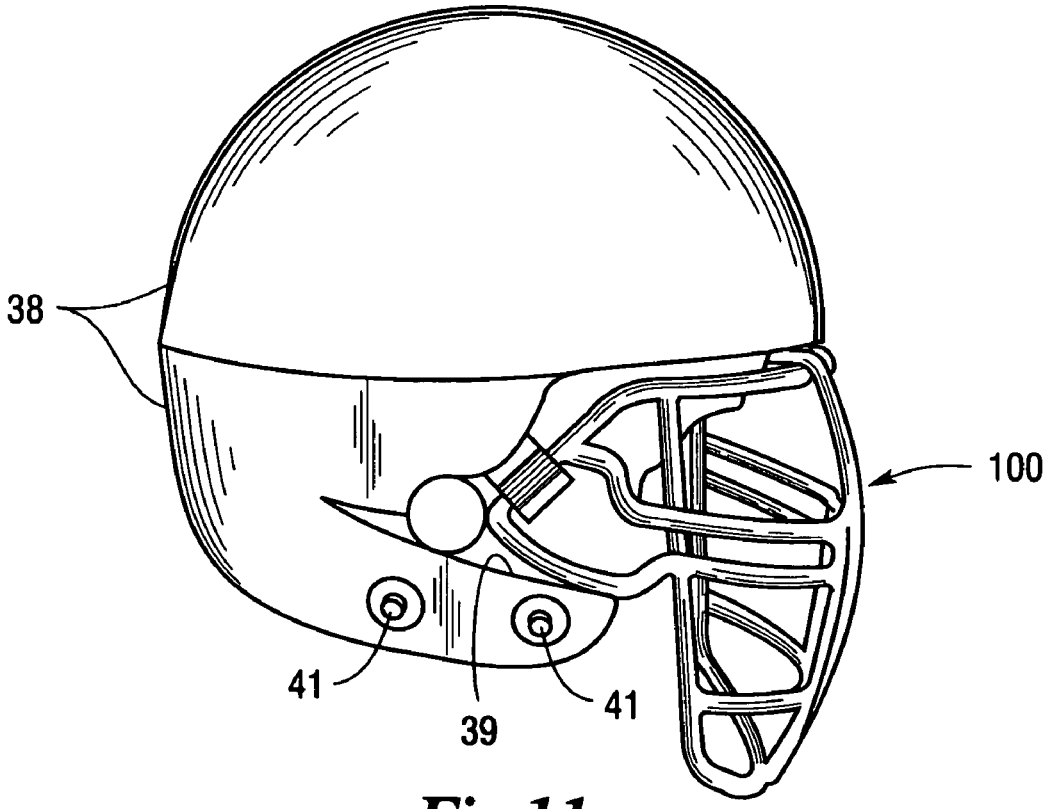
FIG. 11 is a side view of a helmet without side plates and having a recess in the outer layer to receive the end(s) of a face guard.

Referring to FIGS. 2-4, helmet 30 further includes a face guard 100 that is installed through the use of a pair of side plates 102 and 104 installed on the user's right and left sides, respectively, of the helmet 30. Alternatively, the helmet could be used with any type of face guard selected. By way of example, FIG. 10 shows a helmet made according to this invention used with a face guard that is integral with the helmet's side plates, and FIG. 11 shows a helmet made according to this invention used with a conventional face guard.

The side plate 102 has a hole 106 in it to receive a tabbed twist lug assembly 108 that is sized to fit into a notched hole 110 in the user's right side of the hardened shell 32 when the tabs of the twist lug assembly 108 are aligned with the notches in the hole 110. The twist lug assembly 108 can be turned within the hole 110 so that the tabs of the twist lug assembly 108 engage the hardened shell 34 around the hole 110 to lock the side plate 102 in place. Similarly, the side plate 104 has a hole 112 through it to receive a tabbed twist lug assembly 114 which is sized to fit into the notched hole 116 when the tabs of the twist lug assembly 114 are aligned with the notches in the hole 116 in the left user's side of the hardened shell 32. The twist lug assembly 114 can be turned within the hole 116 to cause the tabs on the assembly 114 to lock the side plates 104 in place.

Figure 8:
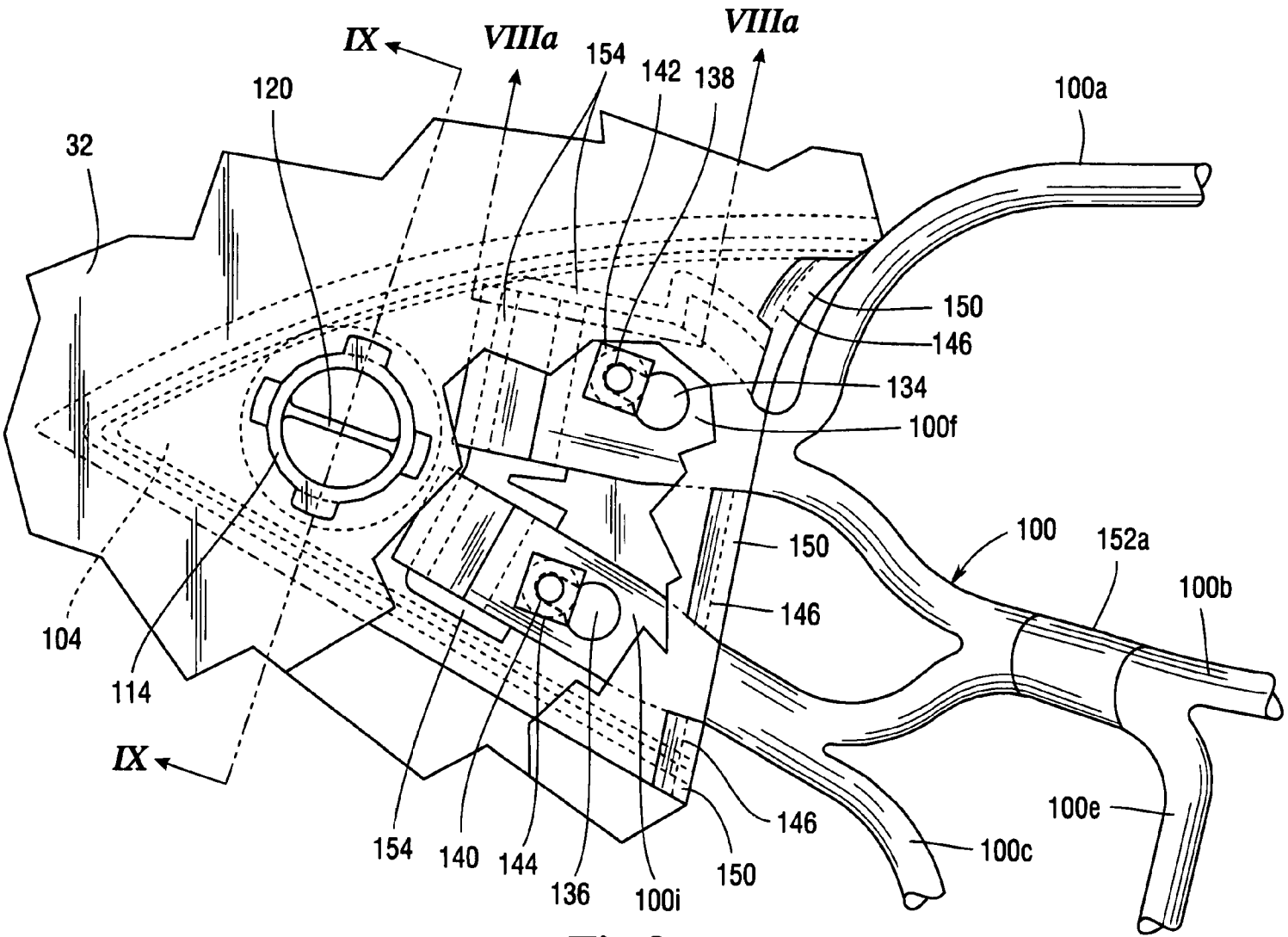
FIG. 8 is an enlarged view, partially cut away, from the inside of the helmet showing the side plate and side plate mounting area of the helmet of FIG. 1.
Figure 9:
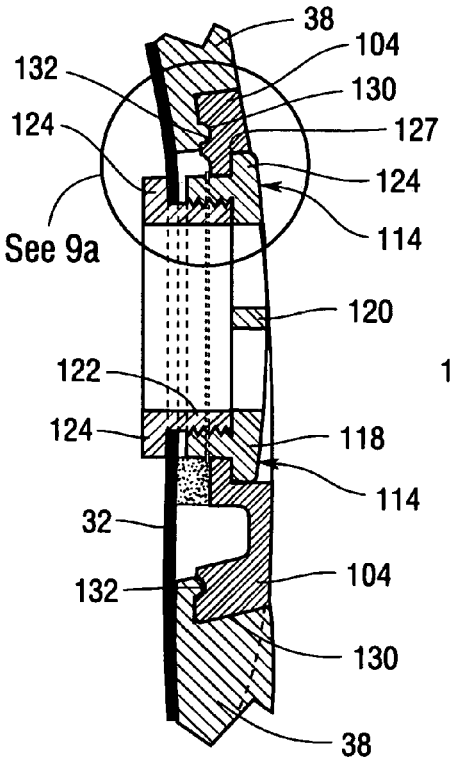
FIG. 9 is a cross section of the side plate and side plate retainer along the line 9-9 as shown in FIG. 3.
Figure 9A:
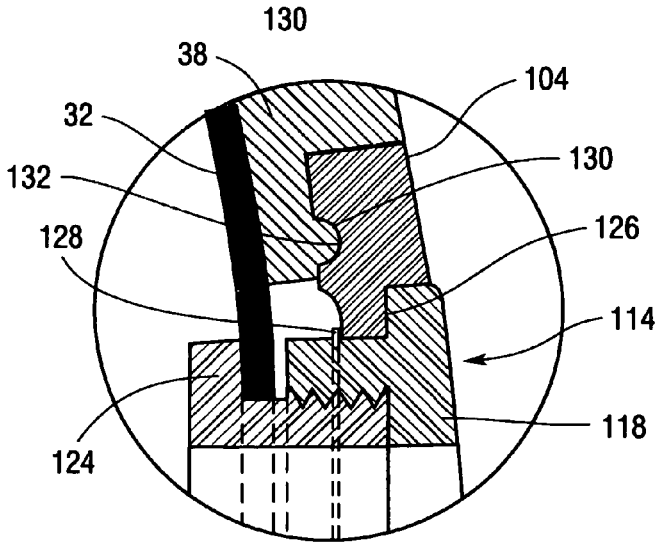
FIG. 9*a* is an enlarged cross section of a portion of FIG. 9.

The structure of the side plates 102 and 104 and their associated tab twist lug assemblies 108 and 114 can be best understood by referring to FIG. 8 which shows a partially cut away view of side plate 104 and tabbed twist lug assembly 114 from FIG. 3 and by referring to FIGS. 9-9*a*. The twist lug assembly 114 includes an outer female lug 118 with internal threads and a centrally located finger bar 120 for use in turning it. The twist lug assembly 114 further includes a notched male member 122 having external threads, which are sized to mesh with the threads of the female lug 118, and also includes tabs 124 which can lock the tabbed twist lug assembly 114 onto the hardened shell 32. The female lug 118 has a head 126 that engages a notch 127 surrounding the hole 112 in the side plate 104. Thus, when the tabs 124 engage the inside surface of the hardened shell 32, the twist assembly lug 114 holds the side plate 104 onto the helmet. Additionally, as best seen in FIG. 9*a*, a snap ring 128 fits around the outside of the female lug 118 and in contact with the underside of the side plate 104 to hold the female lug 118 onto the side plate 104 when the side plate 104 is removed from the hole 116 in the hardened shell 32.

As will be explained below, one function of the side plates 102 and 104 is to secure the face guard 100 onto the helmet 30. Another function of the side plates 102 and 104 is to help anchor the outer layer 38 against the hardened shell 32 to help secure the outer layer 38 in place while the helmet is being used. Referring again to FIGS. 9 and 9*a*, as an example of the structure and function of the side plates 102 and 104, the side plate 104 fits within a notch 130 formed in the periphery of a cut out of the outer layer in the shape of the curved sides of the side place 104. See FIGS. 2 and 3 by way of example. As shown in FIGS. 9 and 9*a*, bead 132 surrounds the outside of the notch 130 in the outer layer 38, and the underside of side plate 104 has a small notch matching the shape of the bead 132 so that the bead 132 can fit into it. As a result, the side plate 104 fits within the notch 130 of the outer layer 38 so that the bead 132 is held within the corresponding notch in the underside of the side plate 104. Thus, when the twist lug assembly 114 locks the side plate 104 onto the helmet, the side plate 104 squeezes the bead 132 and the notch 130 of the outer layer 38 against the hardened shell 32 so as to help retain the outer layer 38 in place during use of the helmet.

Figure 8A:
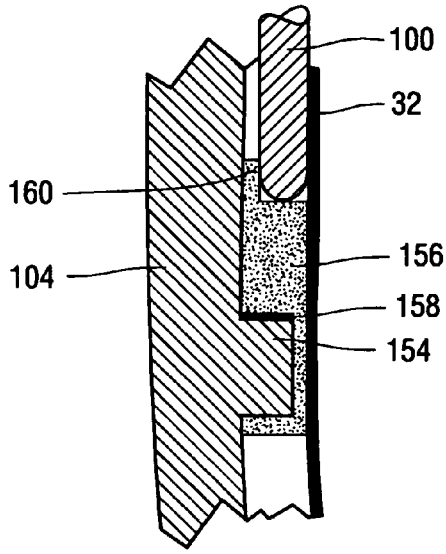
FIG. 8*a* is a cross section of the mounting area of a face guard within the side plate of FIG. 8.

FIGS. 8 and 8*a* show the manner in which the face guard 100 is mounted onto the helmet 30 in the illustrated embodiment of this invention. The construction of the face guard 100 will be more fully explained in relation to FIGS. 16-18*a*. Suffice it to say that the face guard 100 includes an upper bar 100*a*, a middle bar 100*b*, a lower bar 100*c*, a right vertical bar 100*d* and left vertical bar 100*e*. It further includes left upper terminal member 100*f*, a left lower terminal member 100*i*, a right upper terminal member 100*g* and a right lower terminal member 100*h*. Referring now to FIG. 8 and the left side of the helmet 30, by way of example, the left terminal members 100*f* and 100*i* have key hole shaped holes 134 and 136, respectively, cut into their flat surfaces. The left side of the hardened shell 32 has a pair of holes 138 and 140 cut into it corresponding to key hole shaped holes 134 and 136, respectively. Each of the holes 138 and 140 has a square backed T-nut 142 and 144, placed within it, with a round headed screw installed within each T-nut. The large portion of the key holes 138 and 140 can be placed over the heads of the screws of the T-nuts 142 and 144 when the face guard 100 is installed on the hardened shell.

The face plate 104 has a number of elements which enable it to both grip three notches in the front of the hardened shell 32 and to align and hold the face guard 100 in a steady position during its use, while allowing the face guard to be cushioned so as to absorb some of the energy of impacts with it. Notches 146 are shown on the left side of the helmet 32 in FIG. 2. Similar notches 148 are shown on the right side of the front of that helmet.

The side plate 104 has a set of u-shaped fingers 150 which fit within the notches 146 to hold the front end of the side plate against the hardened shell 32. The side plate 104 further includes a ridge 152 which is approximately the thickness of the terminal members 100*f* and 100*i* and is shaped to engage portions of the terminal members 100*f* and 100*i* so as to allow them to be mounted firmly in place on the helmet. Referring to FIG. 8, along with FIG. 8*a*, the side plate 104 also includes a boss 154. The boss 154 has a u-shaped piece of elastomeric material 156 attached to it with an adhesive 158. The upper terminal member 100*f* is installed against the end of the elastomeric material 106, with a tail piece 160 of the material extending between the tip of the terminal member 100*f* and the side plate 104. Each of the other terminal members of the face guard 100 are mounted in a similar manner within the side plates 104 and 102. As a result, impact energy from impacts to the face guard 100 is potentially absorbed by elastomeric members such as 156 that are mounted between the ends of the terminal members and the bosses on the side plates that hold them into place.

A football helmet construction substantially as described above was tested with a standard face guard at the Biomechanical Engineering Laboratory of Wayne State University using the standard test developed to measure the HIC of the helmet. The standard test involved firing a projectile at a selected lateral site and at a selected high frontal site of the helmet, with the helmet placed on a head form integrated with a hybrid III upper torso. The Riddell Revolution helmet was used as a base line for the high frontal tests conducted by Wayne State University. The Riddell VSR4 was used as the base line for the lateral impact tests because the revolution did not properly fit the narrow jaw of the head form used for these tests, which would have put it at a disadvantage for comparison purposes. Each helmet was struck twice by a projectile for each test, and the resulting average was used for evaluation purposes. Impact velocities of the projectiles were between 9 and 10 meters per second.

The results of the tests are set forth in the tables below, and certain of the results are also shown on graphs in FIGS. 15*a*-15*d*.

| Wayne State University Biomechanical Tests<br>Riddell VSR4 vs. Prototype - Lateral Imnact | | | | | | | |
|---|---|---|---|---|---|---|---|
| | VSR4 #1 | VSR4 #2 | Ave. | PC #1 | PC #2 | Ave. | % Reduce |
| HIC (severity) | 766.17 | 622.31 | 694.24 | 420.14 | 569.47 | 494.81 | 29 |
| Y axis Gs | 127.52 | 127.57 | 127.55 | 107.96 | 127.46 | 117.72 | 8 |
| Rotational r/s/s | 8393.9 | 7318.5 | 7856.2 | 6841.0 | 6950.9 | 6895.9 | 12 |
| Peak Force N | 2667.1 | 1142.9 | 1905.0 | 1445.6 | 1190.5 | 1318.1 | 31 |
| Peak Torque Nm | 90.29 | 73.16 | 81.72 | 45.63 | 63.65 | 54.64 | 33 |
| Impact Force N | 9467.4 | 10850.6 | 10159.0 | 8628.1 | 9014.2 | 8821.1 | 13 |
| Riddell Revolution vs. Prototype - Hi Front @ 24 degrees | | | | | | | |
| | Revo #1 | Revo #2 | Ave. | PC #1 | PC #2 | Ave. | % Reduce |
| HIC (severity) | 707.49 | 653.75 | 680.62 | 523.05 | 607.37 | 565.21 | 17 |
| X axis Gs | 150.70 | 142.83 | 146.76 | 121.65 | 136.94 | 129.28 | 12 |
| Z axis Gs | 53.62 | 54.63 | 54.12 | 35.75 | 47.61 | 41.68 | 23 |
| Rotational r/s/s | 1791.99 | 1907.01 | 1849.50 | 1569.73 | 1433.80 | 1501.67 | 19 |
| Peak FxFace N | 1615.02 | 1584.95 | 1599.98 | 1384.92 | 1399.65 | 1392.29 | 13 |
| Peak FzNeck N | 7553.73 | 8003.68 | 7778.70 | 6557.72 | 6523.93 | 6690.83 | 14 |
| Peak Torque Nm | 110.10 | 92.28 | 101.19 | 92.89 | 94.50 | 93.69 | 7 |
| Impact Force N | 13936.37 | 13565.65 | 13751.01 | 11215.80 | 10256.33 | 10736.07 | 22 |

In every measurement recorded by Wayne State University, the prototype helmet (PC) made in accordance with this invention showed a reduction in rotational and linear accelerations due to impact and a reduction in forces and moments from impact in comparison with both the Revolution and the VSR4 helmets. Specifically, in lateral or side impact, the helmet of this invention showed a 29% reduction in the HIC as compared with the VSR4. The reduction in rotational accelerations is important since these are also thought to be causal to catastrophic neck injuries, as well as, concussions. In all respects measured, the helmet of this invention was shown to be superior to the VSR4 and the Revolution helmets.

Figure 12:
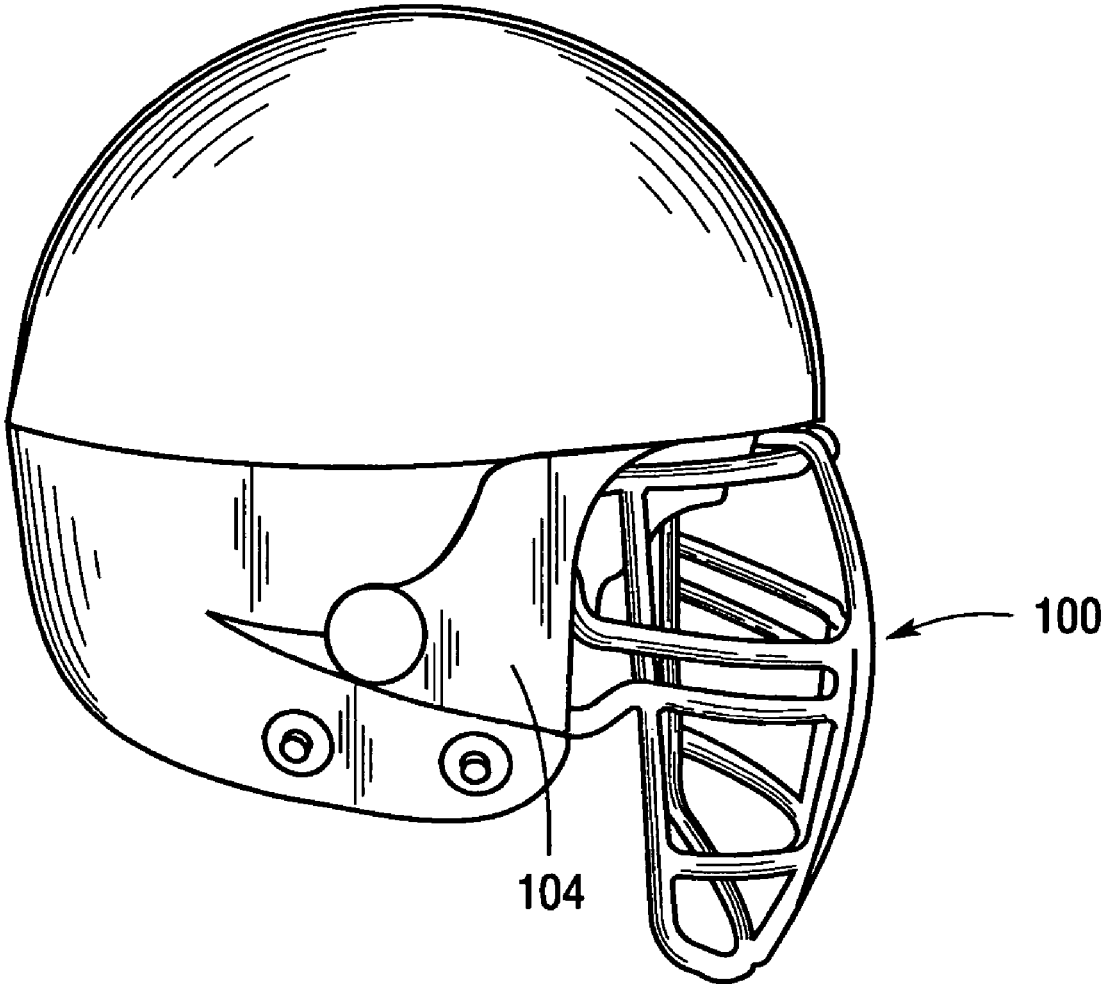
FIG. 12 is a side view of the helmet of FIG. 11 with a filler of outer layer material to cover distal ends of the face guard.

FIG. 10 depicts a face guard 100' which is formed integrally with plates 102' and 104'. FIG. 11 shows a modified helmet with the side plate removed, the helmet having an outer layer 38 with a cutout 39 facilitating attachment of a conventional face guard 100 with snaps 41 on the hardened shell of the helmet to allow the chin strap to be fastened to the helmet. FIG. 12 shows the conventional face guard 100 of FIG. 11 with a covering of the outer layer material 104' in the area where side plates had been installed for the type of face guard described above.

Figures 13A, 13B, 13C, 13D, 14:
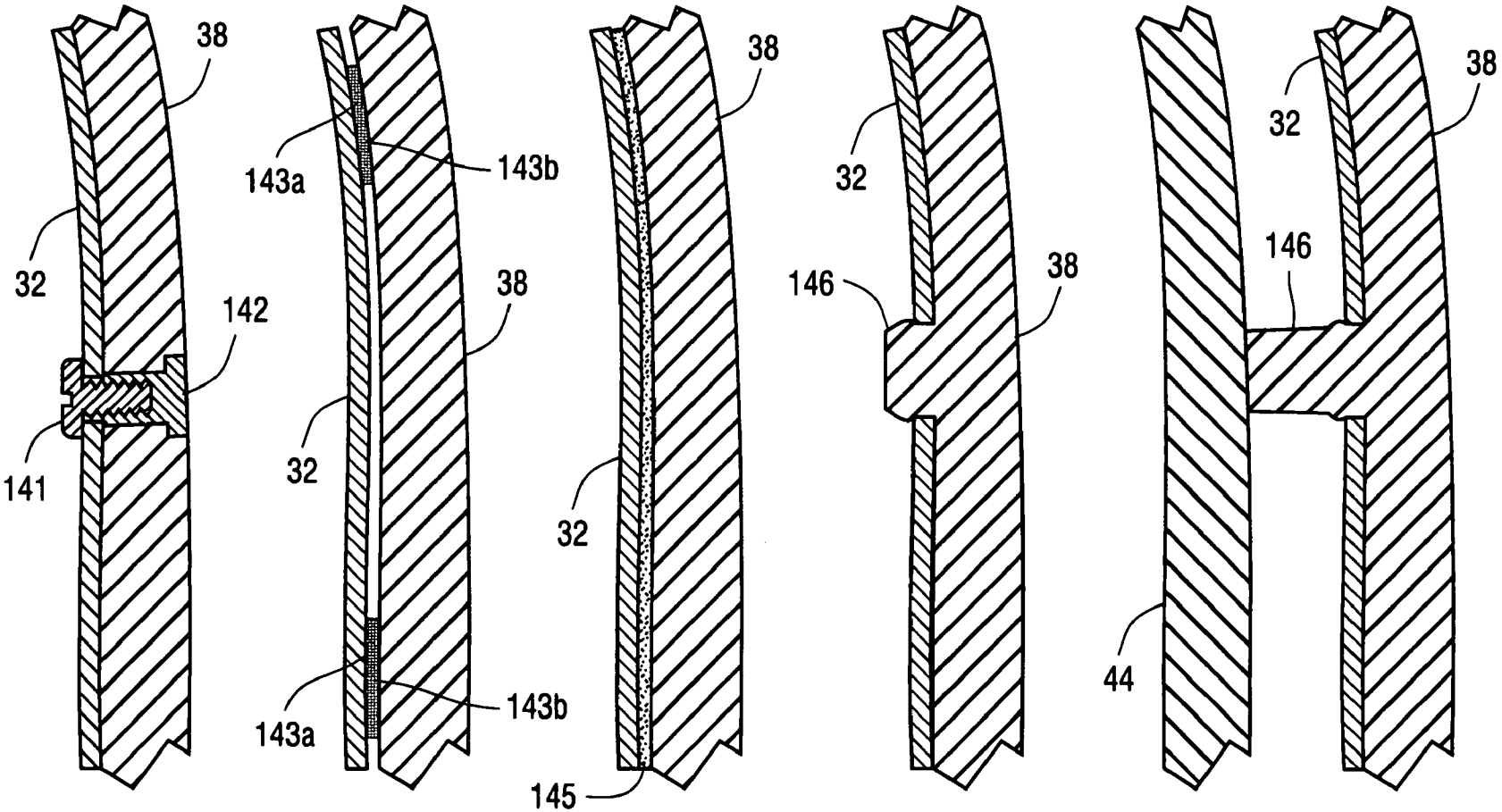
FIG. 13*a* is a cross section of a side of the helmet showing attachment of the outer layer to the shell using a T-nut.
FIG. 13*b* is a cross section of a side of the helmet showing attachment of the outer layer to the shell using hook and loop fasteners.
FIG. 13*c* is a cross section of a side of the helmet showing attachment of the outer layer to the shell using an adhesive.
FIG. 13*d* is a cross section of a side of the helmet showing attachment of the outer layer to the shell through the use of inwardly projecting bosses of portions of the outer shell within open areas of the frame.
FIG. 14 is a cross section of the outer layer frame and inner liner showing inwardly projecting bosses on the outer layer extending through the frame shell to the inner layer.
Figure 15A:
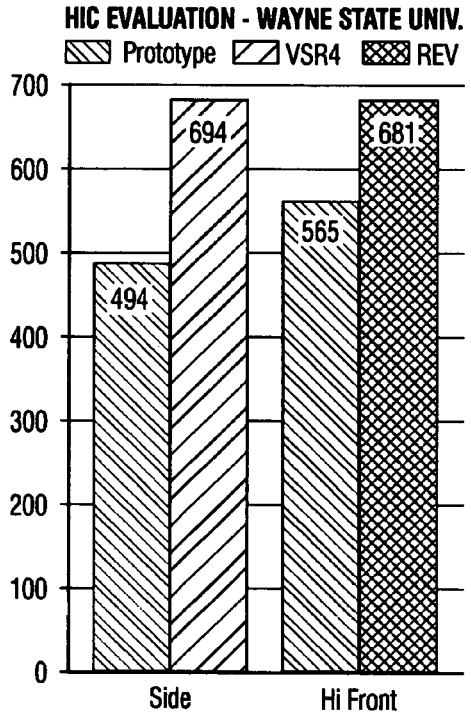
FIG. 15*a* is a graph of Head Injury Criterion resulting from impact tests of helmets.
Figure 15B:
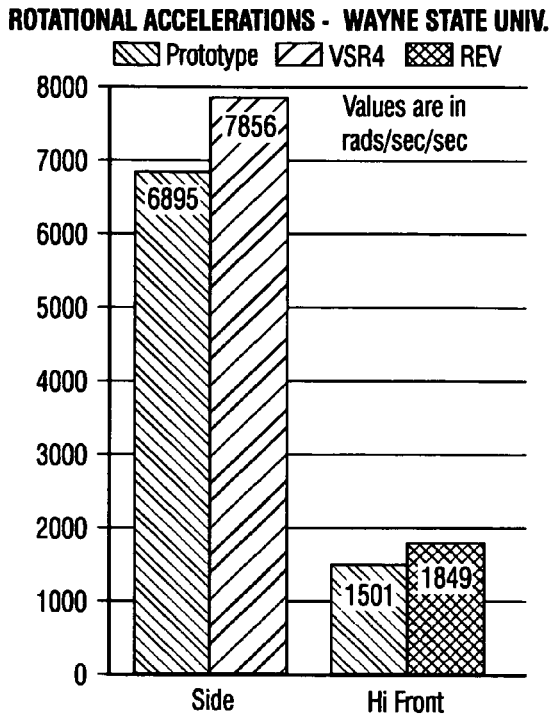
FIG. 15*b* is a graph of rotational accelerations resulting from impact tests of helmets.
Figure 15C:
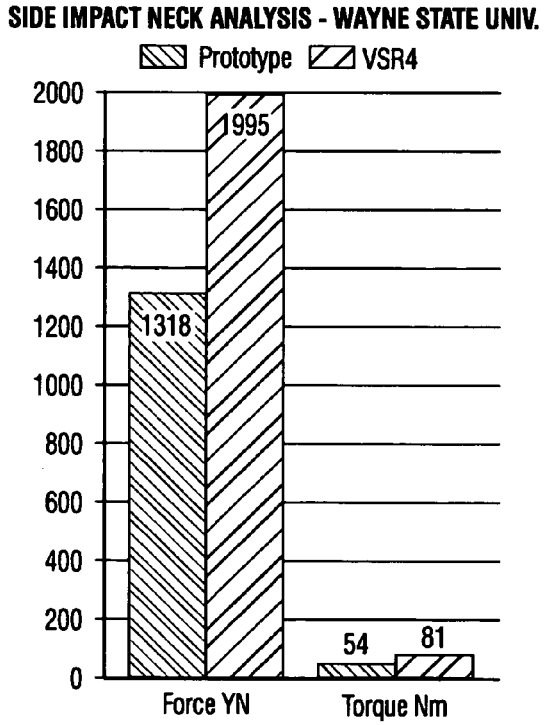
FIG. 15*c* is a graph of side impact neck forces and torque resulting from impact tests of helmets.
Figure 15D:
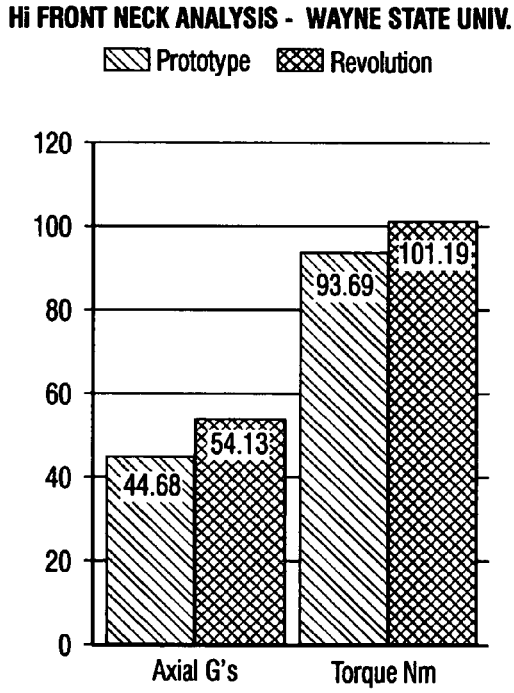
FIG. 15*d* is a graph of high frontal neck G's and torque resulting from impact tests of helmets.
Figure 17:
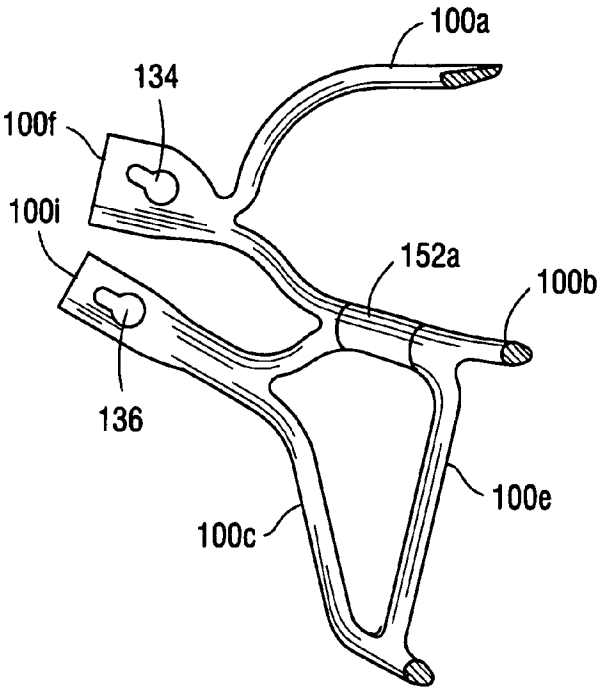
FIG. 17 is a section of the face guard of FIG. 16 along the line 17-17.
Figure 16:
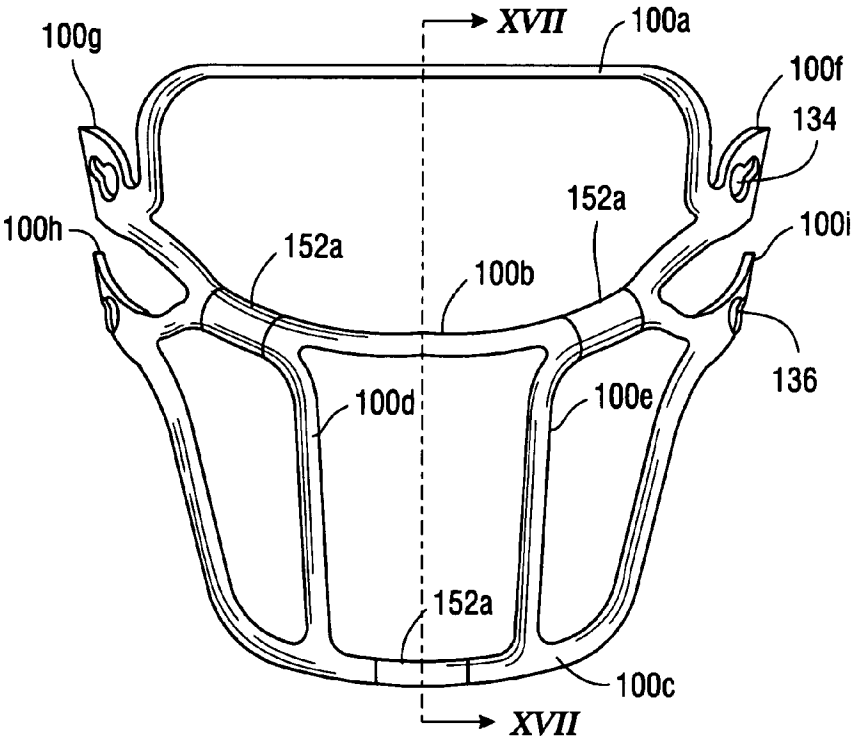
FIG. 16 is a front view of the face guard made of resin impregnated fibers covered with Kevlar material wraps.

FIGS. 13*a*-13*d* show different methods of attaching the outer layer 38 onto the hardened shell 32. FIG. 13*a* shows the attachment of the outer layer to the hardened shell by way of a T-nut 142' having a screw 141' inserted into it from the inside surface of the hardened shell. FIG. 13*b* shows the attachment of the outer layer 38 to the hardened shell 32 by way of hook and loop fasteners 143*a* and 143*b* such as Velcro® fasteners. FIG. 13*c* shows the use of an adhesive 145 to attach the outer layer to the hardened shell. FIG. 13*d* shows the attachment of the outer layer to the hardened shell by means of bosses 146 formed at different locations on the inside surface of the outer layer. Corresponding holes would be formed within the hardened shell so that the bosses could be fitted through the holes to hold the outer layer into place.

FIG. 14 shows a structure similar to FIG. 13*d* wherein the bosses 146' formed within the inner surface of the outer layer extend the distance so that they contact the inner shell 44 of the helmet. The bosses can thus be used to dampen impact forces.

Figure 18A:
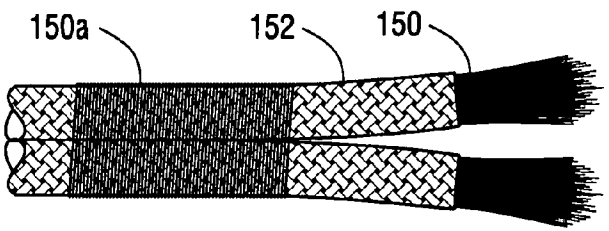
FIG. 18*a* shows two bundles of carbon fibers encased with braided Kevlar which are joined together with resin impregnated carbon fibers.
Figure 18:
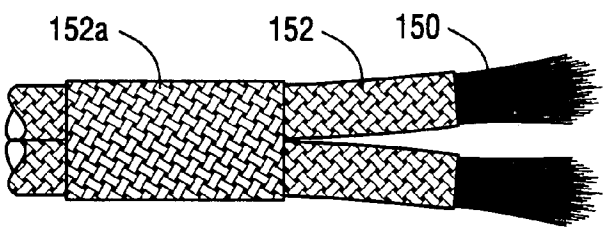
FIG. 18 shows two bundles of carbon fibers encased with braided Kevlar which are joined together with braided Kevlar.

FIGS. 16-18*a* show a football face guard 100 constructed of resin impregnated carbon fibers wrapped 152*a* in Kevlar 150*a*. Each of the bars of the face guard is a separate bundle of Kevlar wrapped resin impregnated carbon fibers. Bars 100*b* and 100*d*, 100*e* of the face mask which come together can be wrapped either with bands of Kevlar as shown in FIG. 18 or bands of resin impregnated fibers as shown in FIG. 18*a*.

Figure 19:
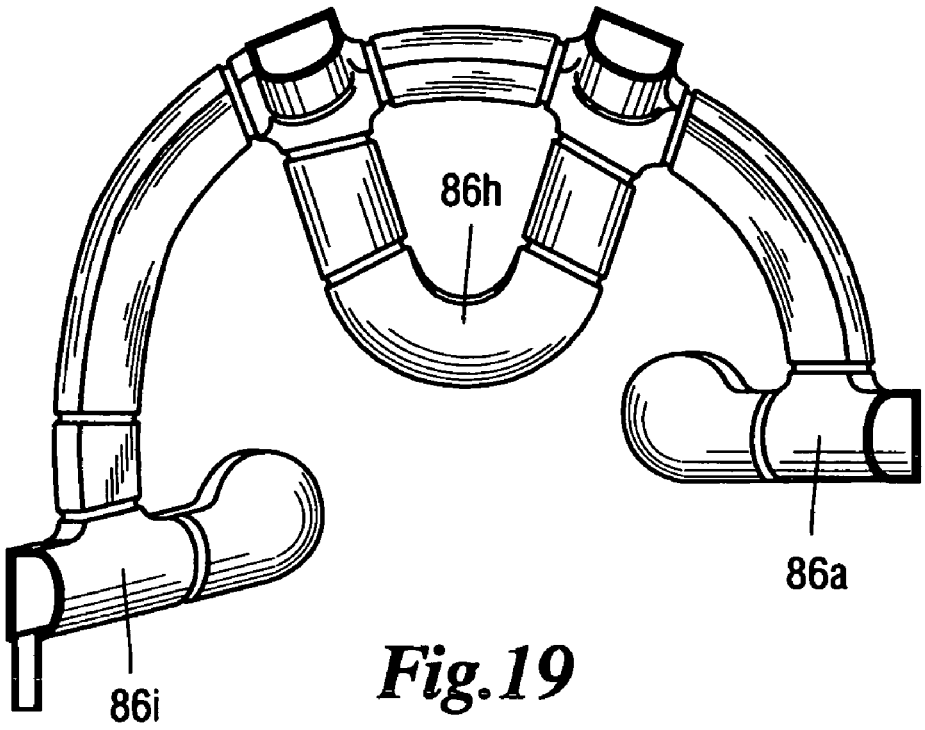
FIG. 19 is a perspective view of an air filled bladder with a built in pump.
Figure 20:
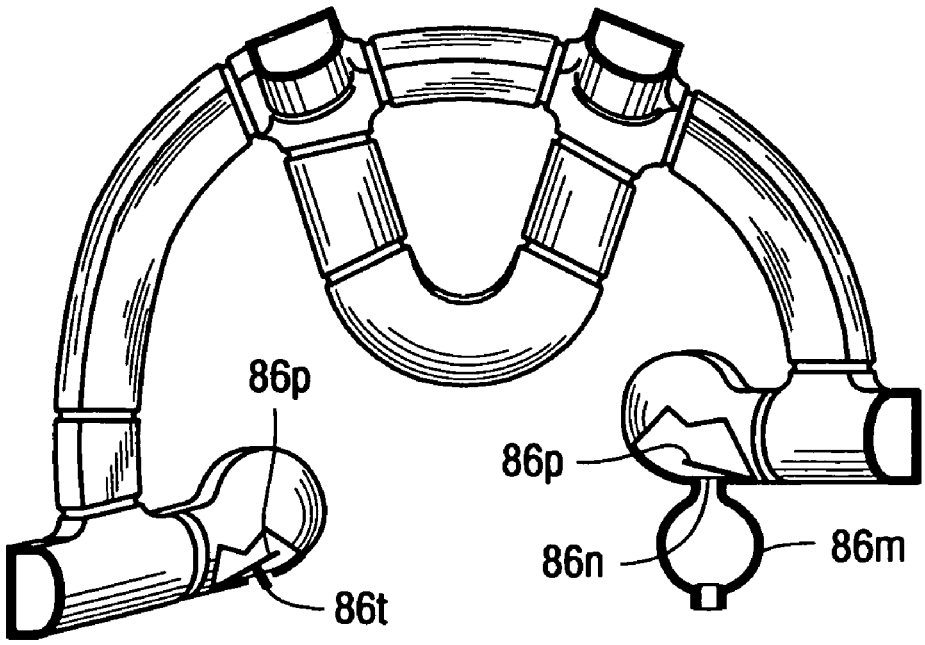
FIG. 20 is a perspective view of an air filled bladder with a built in pump.

FIGS. 19 and 20 show a portion of two separate embodiments of the bladder 86 which can be used with the helmets described above. FIG. 20 shows a self-inflating bladder in which an inflating bulb 86*m* on the right side of the bladder has a hole in it 86*n* which allows the user to pump air through a rubber flap check valve 86*p* within the bladder above the bulb. The left side of FIG. 20 shows a push tab 86*t* attached to a rubber flap check valve 86*p* which can be used to deflate the bladder. FIG. 19 shows a conventional bladder which is inflated through the use of a pump.

Those skilled in the art will recognize that the various features of this invention described above can be used in various combinations with other helmet components without departing from the scope of this invention. Thus, the appended claims are intended to be interpreted to cover such equivalent helmets as do not depart from the spirit and scope of this invention.

I claim:

1. A helmet for protecting a head of a user comprising:

a) a hardened shell having an inside surface and an outside surface;

b) an outer layer comprising an elastomeric cellular, foam material having an integral inner skin and an integral outer skin, said foam material having physical characteristics which cause it to absorb energy from an impact with another object and rapidly and fully recover to absorb energy from the next impact, said outer layer mounted on said hardened shell so that said inner skin is adjacent said outside surface of said hardened shell;

c) connection means for securing a face mask to said hardened shell, said connection means additionally securing said outer layer to said hardened shell.

2. A helmet according to claim 1 wherein said outer skin has a low co-efficient of friction which enables it to deflect an impact from another object which contacts said helmet at an oblique angle.

3. A helmet according to claim 1 wherein said outer skin of said outer layer is thicker than said inner skin.

4. A helmet according to claim 1 wherein said outer layer has a first region of increased thickness at about a front of said helmet and second region of increased thickness towards a rear of said helmet.

5. A helmet according to claim 1 wherein said foam material is a urethane polyol having a density of at least about 4 pounds per cubic foot.

6. A helmet according to claim 1 wherein said hardened shell comprises a frame which includes a first plurality of frame members extending laterally across said helmet and a second plurality of frame members extending longitudinally with respect to said helmet, said first plurality of frame members interconnected with said second plurality of frame members.

7. A helmet according to claim 6 wherein said frame members of said shell are constructed out of fibers impregnated with resin.

8. A helmet according to claim 7 wherein said resin is selected from a group consisting of epoxy, polyester and vinyl ester resins and the fibers selected from a group consisting of carbon, Kevlar and boron fibers.

9. A helmet according to claim 7 further comprising an impact-sensitive dye in said resin which discolors at a given G-force, whereby, should a player manifest signs of head trauma, medical personnel will be able to determine if s/he has suffered a blow to the head of a predetermined amount and a region of said hardened shell where the blow occurred.

10. A helmet according to claim 1 further comprising head fitting structure including a plurality of fitting pads and an inflatable bladder secured inside a foam inner shell which is held in position within said hardened shell by a plurality of visco-elastic cells.

11. A helmet according to claim 1 wherein said connecting means for securing a face mask comprises a quick release mechanism.

12. A helmet according to claim 11 wherein said connecting means further comprises a removable side plate installed on each side of said helmet, each side plate overlapping a portion of said outer layer on a side of said helmet.

13. A helmet according to claim 12 wherein said connecting means further comprises a first inner member and a second outer member which interlock securing said face mask to said hardened shell.

14. A helmet for protecting the head of a user comprising:

a) a hardened shell having an inside surface and an outside surface;

b) a face guard;

c) means for securing said face guard to said hardened shell including a removable side plate installed on each side of said helmet, d) quick release mechanism securing said removable side plate and said face guard to said hardened shell, said quick release mechanism including a first inner lug and a second outer lug, said second outer lug having a central finger bar permitting its rotation without use of another tool, whereby when said quick release mechanism is disengaged, said side plate and said face guard are removed from said hardened shell.

15. A helmet according to claim 14 wherein said first inner member includes tabs which lock said quick release mechanism to said hardened shell.

* * * * *